US009961448B2

(12) United States Patent
Huang

(10) Patent No.: US 9,961,448 B2
(45) Date of Patent: May 1, 2018

(54) DIAPHRAGM AND SUSPENSION EDGE HAVING ELASTIC RIBS, AND SPEAKER

(71) Applicant: TANG BAND INDUSTRIES CO., LTD., Ningbo,Zhejiang (CN)

(72) Inventor: Hsinmin Huang, Ningbo (CN)

(73) Assignee: TANG BAND INDUSTRIES CO., LTD., Ningbo, Zhejiang (CN)

( * ) Notice: Subject to any disclaimer, the term of this patent is extended or adjusted under 35 U.S.C. 154(b) by 0 days. days.

(21) Appl. No.: 15/113,048

(22) PCT Filed: Jan. 22, 2015

(86) PCT No.: PCT/CN2015/071316
§ 371 (c)(1),
(2) Date: Jul. 20, 2016

(87) PCT Pub. No.: WO2015/110038
PCT Pub. Date: Jul. 30, 2015

(65) Prior Publication Data

US 2017/0013365 A1 Jan. 12, 2017

(30) Foreign Application Priority Data

Jan. 22, 2014 (CN) ..... 2014 1 00296053
Mar. 24, 2014 (CN) ..... 2014 1 01110348
(Continued)

(51) Int. Cl.
*H04R 9/06* (2006.01)
*H04R 7/16* (2006.01)
(Continued)

(52) U.S. Cl.
CPC ..... *H04R 9/06* (2013.01); *H04R 7/16* (2013.01); *H04R 7/18* (2013.01); *H04R 9/043* (2013.01);
(Continued)

(58) Field of Classification Search
None
See application file for complete search history.

(56) References Cited

U.S. PATENT DOCUMENTS 8,397,861 B1 * 3/2013 Xu ..... H04R 7/18 181/171
2006/0162993 A1 * 7/2006 Honda ..... H04R 7/18 181/172
2010/0220888 A1 * 9/2010 Huang ..... H04R 9/06 381/400

* cited by examiner

*Primary Examiner* — Matthew Eason
*Assistant Examiner* — Phan Le
(74) *Attorney, Agent, or Firm* — Raymond Y. Chan; David and Raymond Patent Firm

(57) ABSTRACT

A diaphragm and suspension edge includes inner and suspension edge portions. The inner suspension edge portion includes an inner suspension edge body, and one or more inner side elastic ribs protruding relative to the inner suspension edge body. Each inner side elastic rib forms a bulge on a first side of the inner suspension edge portion, and forms a flute on the opposite side. The outer suspension edge portion includes an outer suspension edge body, and one or more outer side elastic ribs protruding relative to the outer suspension edge body. Each outer side elastic rib forms a protrusion on a first side of the outer suspension edge portion, and forms a groove on the opposite side. The suspension edge restricts the displacement direction of the vibration unit of a speaker in the axial vibration direction thereof to prevent offset of the vibration unit.

24 Claims, 34 Drawing Sheets

(30) Foreign Application Priority Data

Mar. 24, 2014 (CN) ..... 2014 1 01113242
Mar. 24, 2014 (CN) ..... 2014 2 01349053 U
Mar. 24, 2014 (CN) ..... 2014 2 01362452 U

(51) Int. Cl.
*H04R 9/04* (2006.01)
*H04R 7/18* (2006.01)

(52) U.S. Cl.
CPC .... *H04R 2307/207* (2013.01); *H04R 2400/11* (2013.01)

A-A

B-B

C-C

D

E-E

F–F

DIAPHRAGM AND SUSPENSION EDGE HAVING ELASTIC RIBS, AND SPEAKER

CROSS REFERENCE OF RELATED APPLICATION

This is a non-provisional application that claims priority to international application number PCT/CN2015/071316, international filing date Jan. 22, 2015, which claims priority to first Chinese application 201400296053, filing date Jan. 22, 2014, second Chinese application 201401110348, filing date Mar. 24, 2014, third Chinese application 2014201349053, filing date Mar. 24, 2014, fourth Chinese application 2014101113242, filing date Mar. 24, 2014, and fifth Chinese application 2014201362452, filing date Mar. 24, 2014, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a speaker, and more particularly to a diaphragm and suspension edge having elastic ribs, and a speaker.

Description of Related Art

A conventional acoustic device, such as a speaker, generally comprises a speaker frame, a vibration diaphragm supported by the speaker frame, a voice coil coupled at the vibration diaphragm, and a magnetic coil unit magnetically inducing with voice coil for driving the vibration diaphragm to vibrate for sound reproduction. In particular, the vibration diaphragm is mounted at an opening of the speaker frame, wherein when the voice coil is magnetically induced to reciprocatingly move, the vibration diaphragm is driven to vibrate correspondingly. However, the vibration direction of the vibration diaphragm is uncontrollable, such that the vibration diaphragm cannot reproduce good sound quality. In order to achieve better sound quality, the vibration diaphragm should only be reciprocatingly moved one direction with even amplitude. For example, when the vibration diaphragm is placed horizontally, the vibration diaphragm should only be reciprocatingly moved in a vertical (up-and-down) direction while the upward displacement of the vibration diaphragm should be the same as the downward displacement of the vibration diaphragm.

An elastic-wave member, also known as center supporting frame, usually made of cotton and synthetic fibers, it is generally disposed in conventional audio devices to control vibration directions of the diaphragm. The elastic-wave member has an inner side coupling with the voice coil and an outer side coupling with the speaker frame. The elastic-wave member is supported to provide a stable spring force, thereby maintaining the voice coil and the diaphragm to return to their initial positions. For example, when the diaphragm moves to its topside position, the elastic force of the elastic-wave member will pull the diaphragm to return to its initial position.

Since the elastic-wave member and the diaphragm are made of different materials, the elastic-wave member and the diaphragm have different elastic forces. In particular, the diaphragm has a greater elastic force than the elastic-wave member, so that when the diaphragm is moved to its topside position, the elastic-wave member pulls the diaphragm to return to its initial position. In other words, when the diaphragm returns to its initial position, there will not be a downward movement of the diaphragm. The elastic-wave member will only pull down the diaphragm to the initial position from the topside position. In addition, since the elastic-wave member has a larger elastic force, the downward pulling movement of the diaphragm is faster than the upward movement of the diaphragm. As a result, the diaphragm reciprocated movement is not uniform in velocity. Since the elastic-wave member makes the voice coil to move in a nonlinear manner. Once the voice coil is not aligned its central axis, the voice coil may scratch and touch the inside of the speaker. The protective coating of the voice coil will gradually be damaged. More importantly, the amplitude of the diaphragm is limited by the large elastic force of the elastic-wave member. Especially for a sound device reproducing a low-frequency sounds, the diaphragm requires a relatively large amplitude to vibrate reciprocally. In other words, the elastic-wave member will affect the reproduction of low frequency sounds.

Because of the elastic-wave member, the voice coil and the speaker frame have a greater distance, and in a conventional speaker, the magnetic coil system and the diaphragm also have a large distance. Thus, a larger space is formed among the diaphragm, the voice coil, the magnetic coil system and the speaker frame. In other words, in the conventional speaker, the voice coil can deviate from its axial displacement direction to produce a greater shaking from side to side and displacements, causing the impure sound.

In addition, in the conventional speaker, the voice coil is connected to the diaphragm and the elastic-wave member, thus the voice coil moves reciprocally under the impact of a magnetic force of the magnetic coil unit, the elastic-wave member can play a role of restricting on the voice coil, so that when the diaphragm is needed to reach a larger amplitude, the pulling force of the elastic-wave member needs to take into account, so that a magnetic force of a magnet of the magnetic coil unit need to be big enough to ensure the diaphragm to overcome the pulling force of the elastic-wave member and has a desired amplitude.

For many small sized devices with audio arrangement such as flat-panel TVs, mobile phones and laptop, these audio arrangement need to be flat and thin, so that the small sized devices can maintain compact product designs and unique shapes. As the elastic-wave member must be supported be the speaker away from the diaphragm, the size of the speaker must be big enough, thereby providing enough space for the movement of the centering supporting frame.

SUMMARY OF THE PRESENT INVENTION

An object of the present invention is to provide a diaphragm and suspension edge, having elastic ribs, for a speaker, wherein the speaker assembled with the suspension having elastic ribs and the diaphragm do not need to be provided an suspension around the voice coil, so that a speaker without the non-elastic wave member is provided to make the configuration to be more compact, the manufacturing to be easier and the production cost to be lower.

Another object of the present invention is to provide a diaphragm and suspension edge having elastic ribs, for a speaker, wherein the suspension edge of the non-suspension speaker comprises a plurality sets of elastic ribs, the plurality sets of elastic ribs restrict the displacement direction of the vibration unit of a speaker in the axial vibration direction thereof to prevent offset of the vibration unit, thereby the suspension is not needed to provide.

Another object of the present invention is to provide a diaphragm and suspension edge having elastic ribs, wherein each set of elastic ribs comprises inner side elastic ribs formed in an inner suspension edge portion of the suspension edge and outer side elastic ribs formed in an outer suspension edge portion of the suspension edge, when the non-suspension speaker is placed vertically and when the vibration unit moves downward from the initial position, the outer side elastic ribs play a role on controlling the movement direction of the vibration unit and prevent offset of the vibration unit, while when the vibration unit moves upward from the initial position, the inner side elastic ribs play a role on controlling movement direction of the vibration unit and prevent offset of the vibration unit, so that the vibration displacement direction of the vibration unit is remained in its axial direction.

Another object of the present invention is to provide a diaphragm and suspension edge having elastic ribs, wherein the inner side elastic ribs and the outer side elastic ribs are respectively formed convex structures. In other words, a first surface thereof is outwardly and convexly provided, while the opposite surface is concavely and inwardly provided, thereby enhancing an cushioning effect.

Another object of the present invention is to provide a diaphragm and suspension edge having elastic ribs, wherein the inner side elastic ribs and the outer side elastic ribs are separated by a connection edge in a middle instead of being integrally formed, so that the restricting effects of the inner side elastic ribs and the outer side elastic ribs will not affect each other.

Another object of the present invention is to provide a diaphragm and suspension edge having elastic ribs, wherein the plurality sets of elastic ribs are radially around the vibration unit and are symmetrically arranged relative to the vibration unit, so that the elastic ribs which are symmetrically positioned on the opposite side have a pulling and restricting effect, thereby preventing the vibration unit deviating along the respective directions perpendicular to the axial direction of the vibration unit.

Another object of the present invention is to provide a diaphragm and suspension edge having elastic ribs, wherein as there is no elastic wave member, the voice coil is only connected to the vibration unit and is only applied a pulling force by the vibration unit, unlike the conventional speaker further pulled by the elastic wave member, so that the voice coil can apply an electromagnetic drive force of the magnetic coil unit to the axial displacement thereof.

Another object of the present invention is to provide a diaphragm and suspension edge having elastic ribs, wherein as the electromagnetic drive force of the magnetic coil unit can be more effectively applied to the axial displacement of the voice coil, so that the magnetic strength of the magnetic coil unit will not be wasted, so that comparing with the conventional speaker, when the vibration unit has the same amplitude, the size of a desired magnet of the magnetic coil unit is smaller, thereby saving more cost.

Another object of the present invention is to provide a diaphragm and suspension edge having elastic ribs, wherein the inner side elastic ribs and the outer side elastic ribs have a misplaced arrangement instead of being symmetrically arranged, thereby enhancing restricting performances.

Another object of the present invention is to provide a diaphragm and suspension edge having elastic ribs, wherein the vibration unit comprises a plurality of wave-shaped convex teeth annularly arranged (a zigzag arrangement), wherein the inner side elastic ribs respectively extend outwardly from the two adjacent convex teeth of the vibration unit, and the inner side of the supporting frame fixed the suspension edge also comprises a plurality of wave-shaped protruding teeth annularly arranged (a zigzag arrangement), wherein the outer side elastic ribs extend outwardly from between two adjacent protruding teeth of the supporting frame, thereby enhancing stability performances of the inner side elastic ribs and the outer side elastic ribs of the outer shells and also enhancing restricting performances thereof.

Additional advantages and features of the invention will become apparent from the description which follows, and may be realized by means of the instrumentalities and combinations particular point out in the appended claims.

According to the present invention, the foregoing and other objects and advantages are attained by a suspension edge, provided around a vibration unit and connected to a supporting frame and adapted for restricting a displacement direction of the vibration unit in an axial vibration direction thereof, comprising:

an inner suspension edge portion comprising an inner suspension edge body and one or more inner side elastic ribs protruded from the inner suspension edge body, wherein each of the inner side elastic ribs forms a bulge on a first side of the inner suspension edge portion, and forms a flute on the opposite side; and an outer suspension edge portion comprising an outer suspension edge body and one or more outer side elastic ribs protruded from the outer suspension edge body, wherein each of the outer side elastic ribs forms a protrusion on a first side of the outer suspension edge portion, and forms a groove on the opposite side.

In one embodiment, two adjacent inner side elastic ribs are provided at interval and each two adjacent outer side elastic ribs are provided at interval.

In one embodiment, the inner side elastic ribs are radially arranged and the outer side elastic ribs are radially arranged.

In one embodiment, the inner side elastic ribs are symmetrically arranged relative to the vibration unit and the outer side elastic ribs are symmetrically arranged relative to the vibration unit.

In one embodiment, the inner side elastic ribs are arranged along a circumferential direction and the outer side elastic ribs are arranged along a circumferential direction.

In one embodiment, the inner side elastic ribs which are arranged along a circumferential direction and the outer side elastic ribs which are arranged along a circumferential direction are co-axially arranged.

In one embodiment, the shapes of protruding cross sections of the inner side elastic ribs are selected from the group consisting of bow, arch, triangular, quadrangular, polygonal, semicircular, semi oval, inverted U-shaped and inverted V-shaped.

In one embodiment, the shapes of protruding cross sections of the outer side elastic ribs are selected from the group consisting of bow, arch, triangular, quadrangular, polygonal, semicircular, semi oval, inverted U-shaped and inverted V-shaped.

In one embodiment, the inner side elastic ribs and the outer side elastic ribs are integrally formed and are extended along different level surfaces.

In one embodiment, the shapes of cross sections of the inner side elastic ribs and the outer side elastic ribs along a direction from an inner side to an outer side are selected from the group consisting of fold-shaped, arch-shaped and wavy.

In one embodiment, a connection edge is formed between the inner suspension edge portion and the outer suspension edge portion, and the inner side elastic ribs and the outer side elastic ribs are respectively positioned on two sides of the connection edge.

In one embodiment, the inner side elastic ribs are integrally formed with the inner suspension edge body and comprise a first section and a second section integrally connected with the first section in different level surfaces.

In one embodiment, the inner side elastic ribs are integrally formed with the inner suspension edge body and comprise a first section and a second section integrally connected with the first section in different level surfaces.

In one embodiment, the vibration unit comprises a first center portion and a second surrounding portion integrally connected with the first center portion in different level surfaces.

In one embodiment, the vibration unit comprises a first center portion, a second surrounding portion provided around the first center portion, and an annular groove is formed between the first center portion and the second surrounding portion.

In one embodiment, a mounting groove is formed between an outer periphery of the first center portion and an inner periphery of the second surrounding portion for mounting the voice coil.

In one embodiment, a first center portion of the vibration unit comprises a body portion and one or more first connecting portions, the first connecting portions and the suspension edge are made of same materials and are integrally formed with the suspension edge and are made of the different materials with the body portion.

In one embodiment, at least two adjacent first connecting portions are arranged at interval to form a first opening.

In one embodiment, the second surrounding portion of the vibration unit comprises an annular body and one or more second connecting portions, the second connecting portions and the suspension edge are made of same materials and are integrally formed with the suspension edge and are made of the different materials with the annular body.

In one embodiment, at least two adjacent second connecting portions are arranged at interval to form a second opening.

In one embodiment, each of the first openings is communicated with the corresponding second opening to form an integral opening.

In one embodiment, the supporting frame comprises a first support frame and a second support frame connected with the first support frame, the suspension edge is connected to the first support frame and the second support frame supports the magnetic coil unit.

In one embodiment, the connection of the first support frame and the second support frame is selected from the group consisting of ultrasonic joining, heat-melt and matched lock components.

In one embodiment, the inner side elastic ribs and the outer side elastic ribs can be aligned or misplaced arranged along a radial direction.

In one embodiment, the vibration unit comprises a plurality of wave-shaped convex teeth arranged on an outer side and a notch is formed between two adjacent convex teeth, wherein the inner side elastic rib is outwardly extended from an outer edge of the notch between two adjacent convex teeth.

In one embodiment, the supporting frame comprises a plurality of wave-shaped protruding teeth annularly arranged inside and an indented groove is formed between two adjacent protruding teeth, wherein the outer side elastic ribs are outwardly extended from an external edge of two adjacent protruding teeth which form the indented groove.

According to the present invention, the foregoing and other objects and advantages are also attained by a speaker suspension edge, comprising an inner suspension edge portion and an outer suspension edge portion, wherein the inner suspension edge portion and the outer suspension edge portion form an arched configuration, and at least one of the inner suspension edge portion and the outer suspension edge portion comprises elastic ribs arranged at interval and protruded along a circumferential direction.

According to the present invention, the foregoing and other objects and advantages are also attained by a diaphragm of a speaker, the speaker comprising a voice coil, a magnetic coil unit and a supporting frame and the voice coil reciprocatingly moving driven by the magnetic coil unit, wherein the diaphragm comprises:

a vibration unit comprising a first center portion and a second surrounding portion provided around the first center portion on one side of the vibration unit and a mounting groove is formed between an outer periphery of the first center portion and an inner periphery of the second surrounding portion so as to mount the voice coil; and a suspension edge provided around the vibration unit and connected to the supporting frame.

In the above diaphragm, the suspension edge comprises:

an inner suspension edge portion comprising an inner suspension edge body and one or more inner side elastic ribs protruded from the inner suspension edge body, wherein each of the inner side elastic ribs forms a bulge on a first side of the inner suspension edge portion, and forms a flute on the opposite side; and an outer suspension edge portion comprising an outer suspension edge body and one or more outer side elastic ribs protruded from the outer suspension edge body, wherein each of the outer side elastic ribs forms a protrusion on a first side of the outer suspension edge portion, and forms a groove on the opposite side.

In one embodiment, the first center portion forms a cap portion and the second surrounding portion forms a skirt portion surrounding the cap portion, and a mounting groove is formed between an outer periphery of the cap portion and an inner periphery of the skirt portion so as to install the voice coil, wherein the cap portion comprises an integral smooth transitioned body portion or sectional and integrally connected in a wavy shape.

In one embodiment, the skirt portion is provided a plurality of reinforcing ribs along a circumferential direction on the side of mounting the voice coil so as to enhance a restoring and reinforcing performance.

According to the present invention, the foregoing and other objects and advantages are also attained by a manufacturing method of a diaphragm, wherein the method comprises the following steps:

(a) providing a vibration unit coupling with a voice coil of a speaker;

(b) connecting a suspension edge to the vibration unit, wherein the suspension edge is provided around the vibration unit and is connected to a supporting frame of the speaker, and the suspension edge comprises:

an inner suspension edge portion comprising an inner suspension edge body and one or more inner side elastic ribs protruded from the inner suspension edge body, wherein each of the inner side elastic ribs forms a bulge on a first side of the inner suspension edge portion, and forms a flute on the opposite side; and an outer suspension edge portion comprising an outer suspension edge body and one or more outer side elastic ribs protruded from the outer suspension edge body, wherein each of the outer side elastic ribs forms a protrusion on a first side of the outer suspension edge portion, and forms a groove on the opposite side.

Preferably, in the above manufacturing method, the suspension edge is bonded with the vibration unit.

Preferably, in the above manufacturing method, in the step (b), disposing the vibration unit and the supporting frame to a mold, and injecting the raw materials which form the suspension edge into the mold by injection molding, forming the suspension edge between the vibration unit and the supporting frame, and coating the raw materials which form the suspension edge on the vibration unit so as to integrally connect the vibration unit with the suspension edge.

Preferably, in the above manufacturing method, in the step (b), providing a plurality of protruding portions, so that the raw materials which form the suspension edge form the inner side elastic ribs and the outer side elastic ribs on the corresponding position of the protruding portions.

Preferably, in the above manufacturing method, the vibration unit comprising a first center portion and a second surrounding portion provided around the first center portion on one side of the vibration unit and a mounting groove is formed between an outer periphery of the first center portion and an inner periphery of the second surrounding portion for mounting the voice coil.

According to the present invention, the foregoing and other objects and advantages are also attained by a speaker, comprising:

a magnetic coil unit, a voice coil reciprocatingly moving driven by the magnetic coil unit, a vibration unit coupling with the voice coil, a supporting frame, and a suspension edge provided around the vibration unit and connected to the supporting frame, wherein the suspension comprises:

an inner suspension edge portion comprising an inner suspension edge body and one or more inner side elastic ribs protruded from the inner suspension edge body, wherein each of the inner side elastic ribs forms a bulge on a first side of the inner suspension edge portion, and forms a flute on the opposite side; and an outer suspension edge portion comprising an outer suspension edge body and one or more outer side elastic ribs protruded from the outer suspension edge body, wherein each of the outer side elastic ribs forms a protrusion on a first side of the outer suspension edge portion, and forms a groove on the opposite side.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
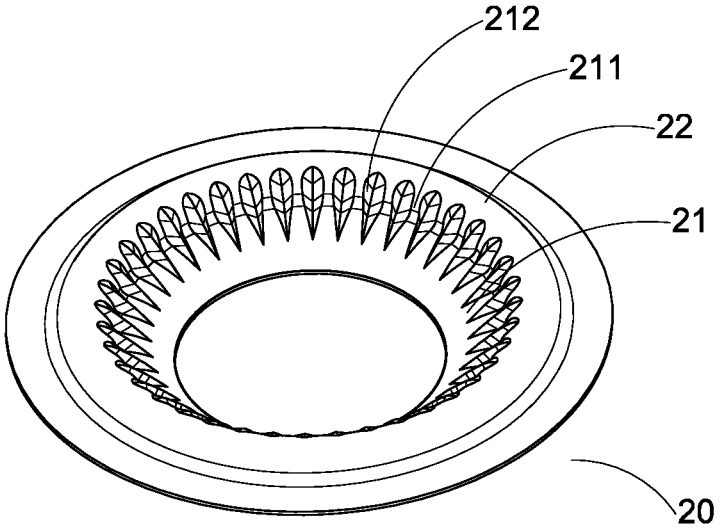
FIG. 1 is a perspective view of a suspension edge with elastic ribs according to a first preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 1 to FIG. 17 of the drawings, a speaker, i.e. without the conventional elastic wave member, comprises a suspension edge 20 having an elastic rib and a diaphragm according to a preferred embodiment of the present invention is illustrated. The speaker comprises a supporting frame 10, a suspension edge 20, a vibration unit 30, a voice coil 40, a magnetic loop unit 50 and other speaker necessary components. In the speaker of the present invention, there is no suspension of a traditional speaker. One skilled in the art will understand that the suspension edge 20 and the diaphragm of the embodiment of the present invention as shown in the drawings can be applied in other speakers or sound devices, including a conventional speaker having an suspension.

Figure 12:
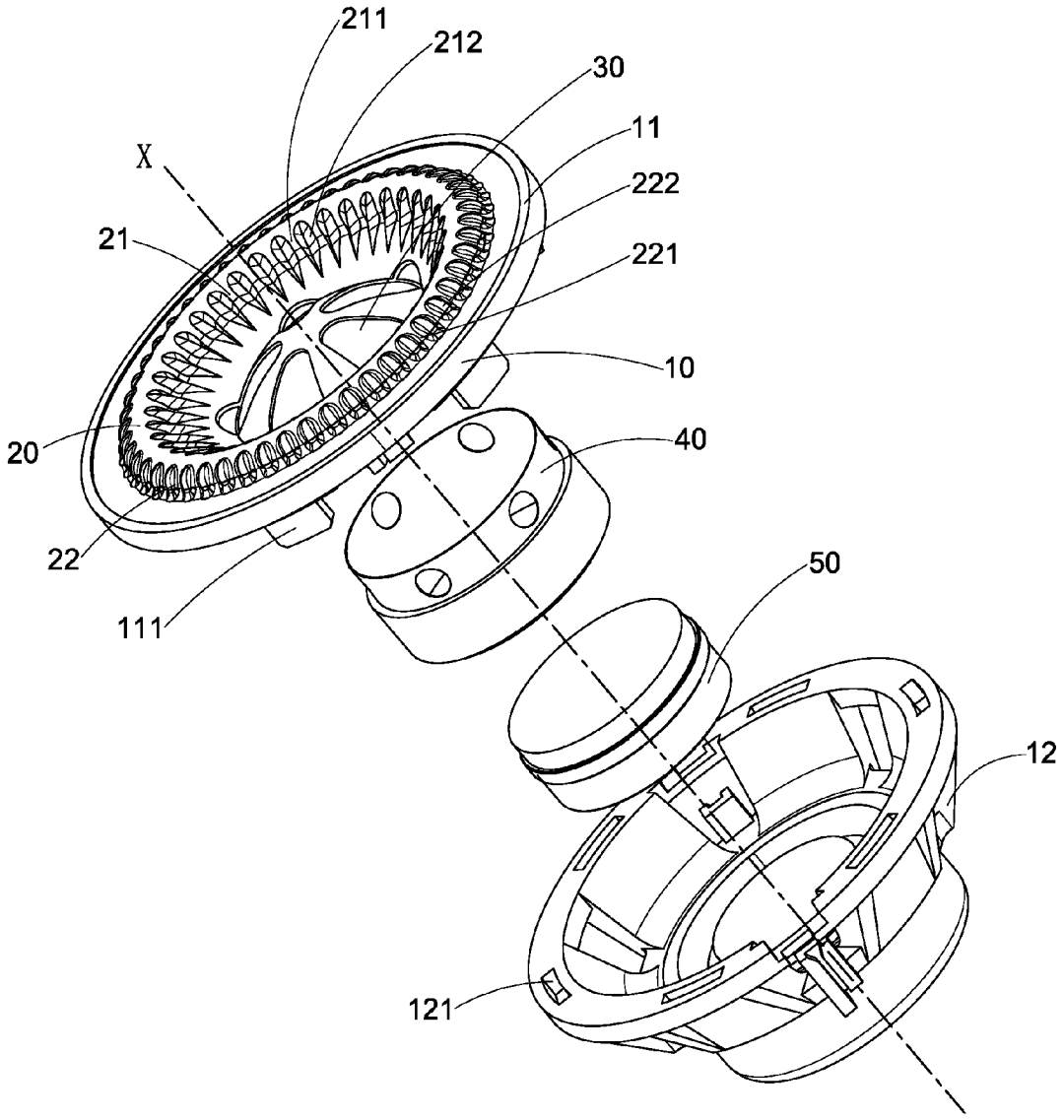
FIG. 12 is an exploded schematic view of a speaker assembled the diaphragm according to above fifth preferred embodiment of the present invention.
Figure 13:
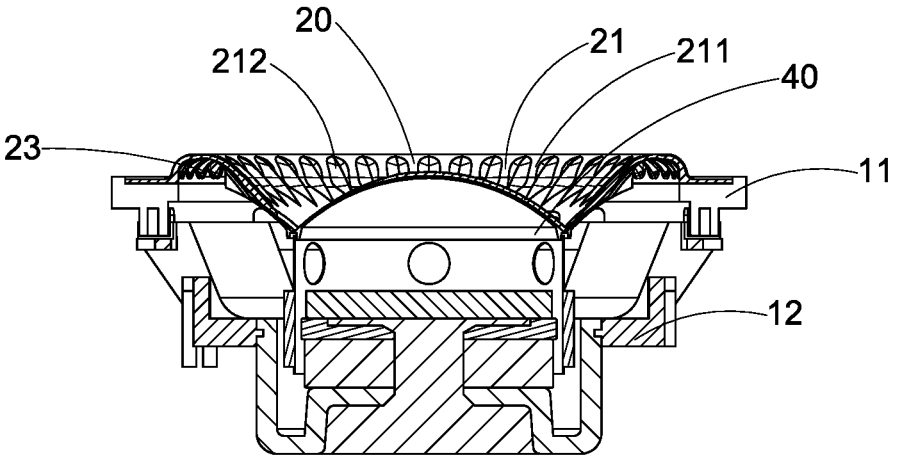
FIG. 13 is a sectional cross sectional view of the FIG. 10 along an A-A line.

The suspension edge 20 of the present invention is made of an elastic material and is provided between the vibration unit 30 and the supporting frame 10. One end of the voice coil 40 is connected with the vibration unit 30 and the other end of the voice coil 40 is coupled with the magnetic loop unit 50. The voice coil 40 moves reciprocatingly in response to an electromagnetic driver force of the magnetic loop unit 50 so as to drive the vibration unit 30 to move reciprocatingly along an axial direction such as an X-axial direction as shown in FIG. 12. Therefore, the air within the speaker is driven to reproduce sounds. The suspension edge 20 restricts the displacement direction of the vibration unit 30 in the axial direction which is the X-axial direction. Correspondingly, the diaphragm of the present invention comprises the suspension edge 20 and the vibration unit 30. The diaphragm only moves along the axial direction and will not be deviated.

Specifically, as shown in FIG. 1, according to a first preferred embodiment of the present invention, the suspension edge 20 of the present invention comprises an inner suspension edge portion 21 and an outer suspension edge portion 22. The inner suspension edge portion 21 and the outer suspension edge portion 22 can be integrally formed and annularly surrounded the vibration unit 30. The inner suspension edge portion 21 is molded with the outer suspension edge portion 22 and form a fold-shaped, arch-shaped or wavy configuration along a cross-section direction. As shown in FIG. 1, the inner suspension edge portion 21 and the outer suspension edge portion 22 are integrally connected and form an arch-shaped configuration. The inner suspension edge portion 21 and the outer suspension edge portion 22 are respectively positioned two sides of the peak of the arch-shaped configuration.

In this preferred embodiment of the present invention, the inner suspension edge portion 21 of the suspension edge 20 comprises an inner suspension edge body 211 and a plurality of inner side elastic ribs 212. The inner side elastic ribs 212 are spaced and arranged along a circumferential direction. The inner side elastic ribs 212 are integrally and protruding extended from the inner suspension edge bodies 211 respectively.

Two adjacent inner side elastic ribs 212 are provided at interval and the inner side elastic ribs 212 are radially arranged so as to restrict the displacement direction of the suspension edge 20 in an axial direction. Specifically, when the suspension edge 20 is about to have a displacement in a predetermined deviating axial direction, the inner side elastic ribs 212 in an opposite direction will have a restricting effect to prevent a further deviation of the suspension edge 20.

Figure 2:
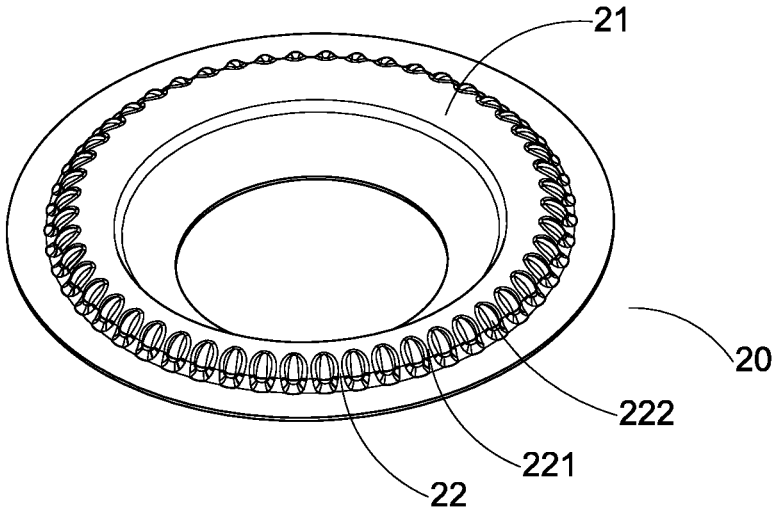
FIG. 2 is a perspective view of a suspension edge with elastic ribs according to a second preferred embodiment of the present invention.

As shown in FIG. 2, according to a second embodiment of the present invention, the suspension edge 20 comprises the inner suspension edge portion 21 and the outer suspension edge portion 22. Different with the above embodiment, the inner suspension edge portion 21 is not provided elastic ribs and the outer suspension edge portion 22 comprises an outer suspension edge body 221 and a plurality of outer side elastic ribs 222. The outer side elastic ribs 222 are integrally and protruding extended from the outer suspension edge body 221.

Similarly, two adjacent outer side elastic ribs 222 are provided at interval and the inner side elastic ribs 212 are radially arranged so as to restrict the displacement direction of the suspension edge 20 in an axial direction.

Figure 3:
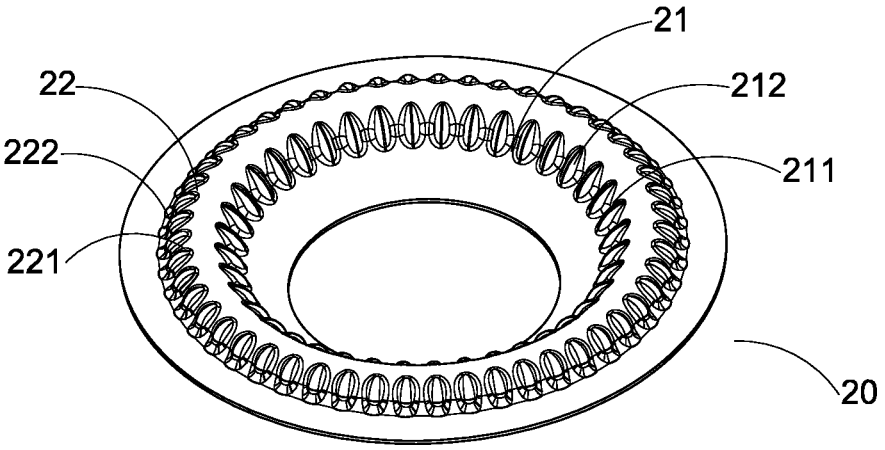
FIG. 3 is a perspective view of a suspension edge with elastic ribs according to a third preferred embodiment of the present invention.

As shown in FIG. 3, according to a third embodiment of the present invention, the suspension edge 20 comprises the inner suspension edge portion 21 and the outer suspension edge portion 22. The inner suspension edge portion 21 has the inner side elastic ribs 212 and the outer suspension edge portion 22 has the outer side elastic ribs 222. In other words, in this preferred embodiment, the inner suspension edge portion 21 and the outer suspension edge portion 22 all have elastic ribs to prevent deviation.

Figure 4:
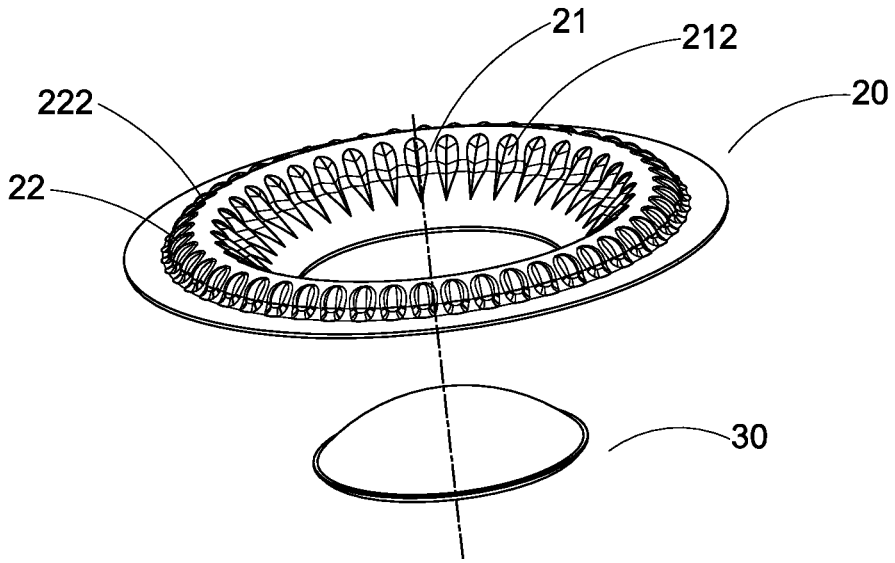
FIG. 4 is an exploded perspective view of a diaphragm according to above third preferred embodiment of the present invention.

As shown in FIG. 4, the diaphragm comprises the suspension edge 20 and the vibration unit 30. The suspension edge 20 surrounds the vibration unit 30 so as to restrict the displacement direction of the vibration unit 30 in the axial direction thereof. It is worth mentioning that the inner side elastic ribs 212 and the outer side elastic ribs 222 of the suspension edge 20 have a protrusion shaped. As shown in FIG. 1, the inner side elastic ribs 212 is an extended convex shaped configuration and has a decrease width along a direction from outside to inner side. As shown in FIG. 2 and FIG. 3, the inner side elastic ribs 212 and the outer side elastic ribs 222 are circular protrusions.

Figure 5:
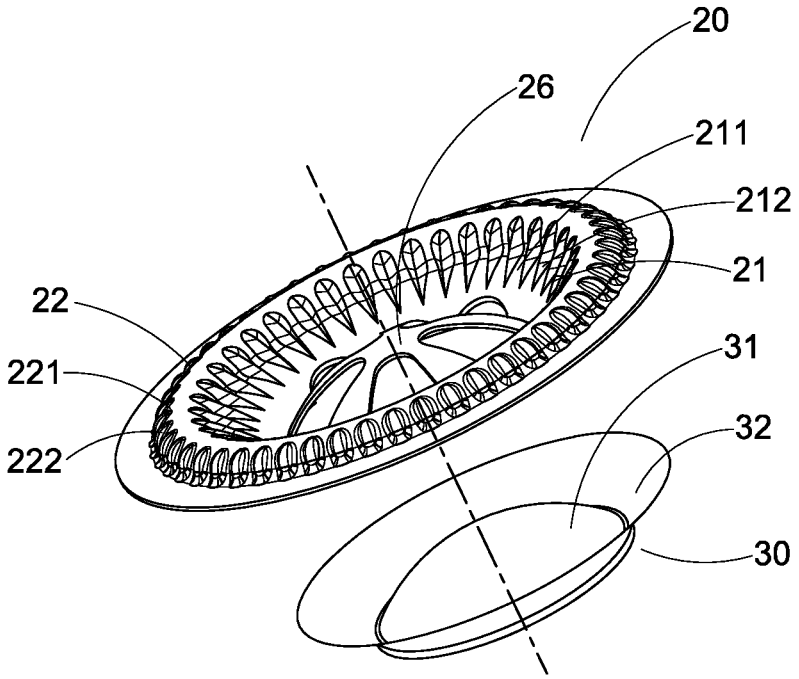
FIG. 5 is an exploded perspective view of a diaphragm according to above fourth preferred embodiment of the present invention.

As shown in FIG. 5, according to a fourth embodiment of the present invention, the suspension edge 20 further comprises a connecting body 26. The connecting body 26 is made of the same material with the inner suspension edge portion 21 and the outer suspension edge portion 22. The connecting body 26 is formed by injection molding that the connecting body is integrally extended within the inner suspension edge portion 21. When the injection molding material forms the inner suspension edge portion 21 and the outer suspension edge portion 22, the vibration unit 30 is overlapped and coated with and embedded in the injection molding material and the connecting body 26 is formed, so that the suspension edge 20 and the vibration unit 30 are integrally formed, thus unlike the conventional method, the suspension edge 20 and the vibration unit 30 are bonded by glue.

In addition, in this preferred embodiment of the present invention, the vibration unit 30 comprises a first center portion 31 positioned at the center and a second surrounding portion 32 encircling around the first center portion 31. The first center portion 31 can be cap-shaped and can comprise a dust cap structure. In the actual needs, the first center portion 31 also comprises a heavier blocks, such as aluminum iron, copper and the like. The second surrounding portion 32 obliquely extends from an outer edge of the first center portion 31 to the surroundings and has a gradually increased diameter so as to form a similar tapered structure or conical structure. The inner suspension edge portion 21 of the suspension edge 20 fits to and couples at the second surrounding portion 32 of the vibration unit 30.

Referring to FIG. 6 to FIG. 17 of the drawings, the suspension edge 20 having elastic ribs, the diaphragm and the non-suspension speaker assembled with the suspension edge 20 and the diaphragm according to a fifth preferred embodiment of the present invention is illustrated. The suspension edge 20 also has an elastic ribs configuration so as to prevent the non-suspension speaker reproducing noises.

More specifically, in this preferred embodiment of the present invention, the suspension edge 20 of the present invention comprises the inner suspension edge portion 21 and the outer suspension edge portion 22. The inner suspension edge portion 21 and the outer suspension edge portion 22 can be integrally formed and annularly surround the vibration unit 30. The inner suspension edge portion 21 is connected to the vibration unit 30, the outer suspension edge portion 22 is connected to the supporting frame 10, so that the suspension edge 20 is extended between the vibration unit 30 and the supporting frame 10.

Figure 8:
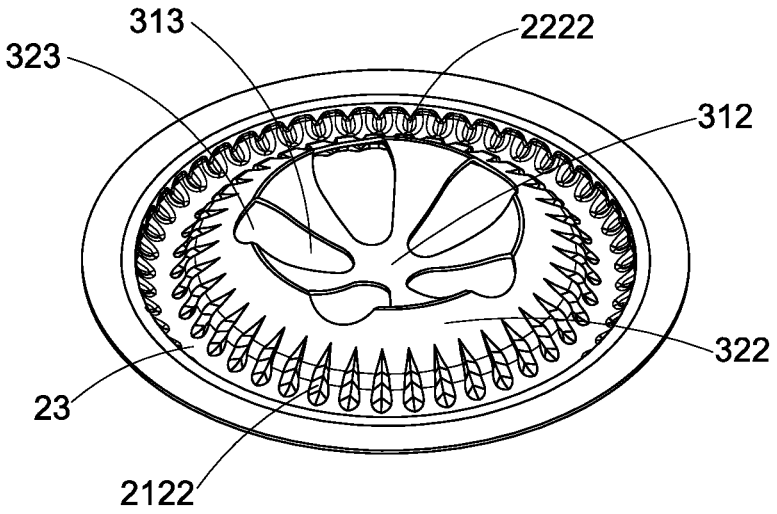
FIG. 8 is a bottom schematic view of the suspension edge according to above fifth preferred embodiment of the present invention.

The inner suspension edge portion 21 is molded with the outer suspension edge portion 22 and form a fold-shaped, arch-shaped or wavy configuration along a cross-section direction. In other words, as shown in FIG. 8, the inner suspension edge portion 21 and the outer suspension edge portion 22 extend around the vibration unit 30 to form an annular groove 23 between the inner suspension edge portion 21 and the outer suspension edge portion 22 instead of extending along a same level surface.

The inner suspension edge portion 21 comprises the inner suspension edge body 211 and the plurality of inner side elastic ribs 212. The inner side elastic ribs 212 are spaced and arranged along a circumferential direction. The inner side elastic ribs 212 are convexly provided, so that the inner side elastic ribs 212 form a bulge 2121 on a first side of the inner suspension edge portion 21 and form a flute 2122 on an opposite second side of the inner suspension edge portion 21. In other words, the inner side elastic ribs 212 protrude from the level surface of the inner suspension edge body 211 on the first side, while the inner side elastic ribs 212 concave inwardly from the level surface of the inner suspension edge body 211 on the opposite second side.

Figure 6:
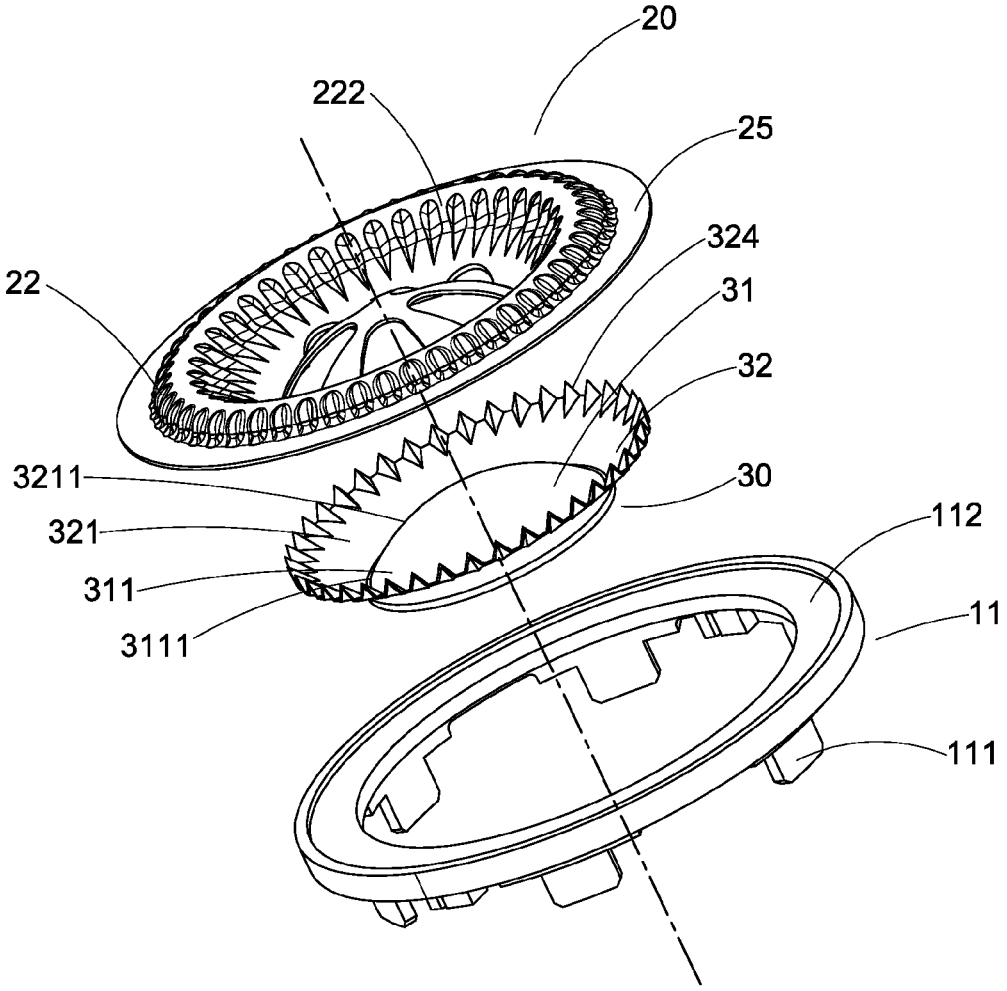
FIG. 6 is an exploded perspective view of the suspension edge and a diaphragm according to above fifth preferred embodiment of the present invention.

Two adjacent inner side elastic ribs 212 are provided at interval and the inner side elastic ribs 212 are radially arranged so as to restrict the displacement direction of the vibration unit 30 in the X-axial direction as shown in the drawings. Specifically, as shown in FIG. 5 and FIG. 6, when the non-suspension speaker is placed vertically, each inner side elastic ribs 212 are upwardly protruded from the inner suspension edge body 211 so as to form the bulge 2121 on an upper side of the inner suspension edge portion 21 and to form the flute 2122 on a lower side of the inner suspension edge portion 21. One skilled in the art will understand that the inner side elastic ribs 212 can be upwardly protruded from the inner suspension edge body 211 so as to form the bulge 2121 in the lower side of the inner suspension edge portion 21 and to form the flute 2122 in the upper side of the inner suspension edge portion 21.

As shown in the drawings, the inner side elastic ribs 212 are symmetrically arranged around the vibration unit 30, wherein each of the inner side elastic ribs 212 comprise a left inner side elastic rib 212*a* and a right inner side elastic rib 212*b*. The mechanism of action of the inner suspension edge portion 21 for preventing the deviation of the vibration unit 30 is as follows. The vibration unit 30 is about to move from its initial position and to move upwardly along the axial direction. If the vibration unit 30 is about to move at its axial direction and to deviate to the left, the left inner side elastic rib 212*a* applies a pulling force on the vibration unit 30 to prevent a further leftward deviation of the vibration unit 30. If the vibration unit 30 is about to move its axial direction and to deviate to the right, the right inner side elastic rib 212*b* applies a pulling force on the vibration unit 30 to prevent a further rightward deviation of the vibration unit 30. Thus, the vibration unit 30 only moves along its axial direction, so that the speaker reproduces pure sounds.

The outer suspension edge portion 22 comprises the outer suspension edge body 221 and the outer side elastic ribs 222. The outer side elastic ribs 222 are spaced and arranged along a circumferential direction. The outer side elastic ribs 222 are convexly provided, so that the outer side elastic ribs 222 form a protrusion 2221 on a first side of the 22 and form a groove 2222 on an opposite second side of the outer suspension edge portion 22. In other words, the outer side elastic ribs 222 protrude from the level surface of the outer suspension edge body 221 on the first side, while the outer side elastic ribs 222 concave inwardly from the level surface of the outer suspension edge body 221 on the opposite second side.

Figure 14:
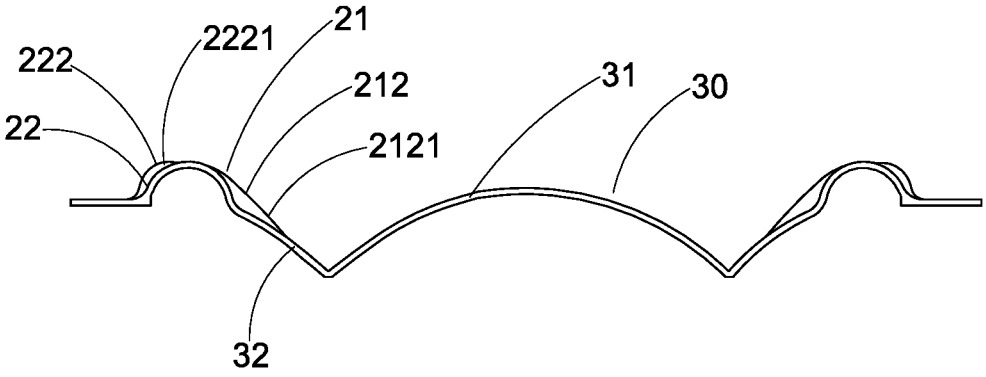
FIG. 14 is a sectional view of the FIG. 10 along a B-B line, illustrating the structure of the suspension of the speaker according to above fifth preferred embodiment of the present invention.
Figure 15:
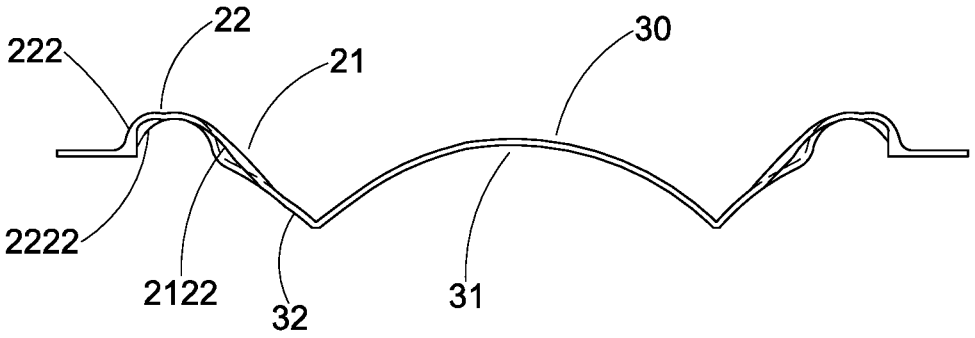
FIG. 15 is a sectional view of the FIG. 10 along a C-C line, illustrating the structure of the suspension of the speaker according to above fifth preferred embodiment of the present invention.

Two adjacent outer side elastic ribs 222 are provided at interval and the outer side elastic ribs 222 are radially arranged so as to restrict the displacement direction of the vibration unit 30 in the X-axial direction as shown in the drawings. Specifically, as shown in FIG. 14 and FIG. 15, when the non-suspension speaker is placed vertically, each outer side elastic ribs 222 are upwardly protruded from the outer suspension edge body 221 so as to form the protrusion 2221 on an upper side of the outer suspension edge portion 22 and to form the groove 2222 on a lower side of the outer suspension edge portion 22. One skilled in the art will understand that the each outer side elastic ribs 222 can be upwardly protruded from the outer suspension edge body 221 so as to form the protrusion 2221 in the lower side of the outer suspension edge portion 22 and to form the groove 2222 in the upper side of the outer suspension edge portion 22.

As shown in the drawings, the outer side elastic ribs 222 are symmetrically arranged around the vibration unit 30, wherein each of the outer side elastic ribs 222 comprise a left outer side elastic rib 222*a* and a right outer side elastic rib 222*b*. The mechanism of action of the outer suspension edge portion 22 for preventing the deviation of the vibration unit 30 is as follows. The vibration unit 30 is about to move from its initial position and to move upwardly along the axial direction. If the vibration unit 30 is about to move from its axial direction and to deviate to the left, the left outer side elastic rib 222*a* applies a pulling force on the vibration unit 30 to prevent a further leftward deviation of the vibration unit 30. If the vibration unit 30 is about to move from its axial direction and to deviate to the right, the right outer side elastic rib 222*b* applies a pulling force on the vibration unit 30 to prevent a further rightward deviation of the vibration unit 30. Thus the vibration unit 30 only moves along its axial direction, so that the speaker reproduces more pure sounds.

It is worth mentioning that the inner side elastic ribs 212 and the outer side elastic ribs 222 are provided one by one correspondingly. In other words, the inner side elastic ribs 212 of the inner suspension edge portion 21 are corresponded to and aligned with the outer side elastic ribs 222 of the outer suspension edge portion 22. Thus, the suspension edge 20 of the present invention comprises a plurality sets of elastic ribs. Each sets of the elastic ribs comprise one inner side elastic rib 212 of the inner suspension edge portion 21 and one outer side elastic rib 222 of the inner side elastic rib 212. Each sets of the elastic ribs are arranged at an interval along a circumferential direction. Take the vertically placed speaker as an example, when the vibration unit 30 is about to move from its initial position and to move upwardly, the inner side elastic rib 212 of each sets of the elastic ribs restricts the displacement direction of the vibration unit 30 to prevent deviation. When the vibration unit 30 is about to move from its initial position and to move downwardly, the outer side elastic rib 222 of each sets of the elastic ribs restricts the displacement direction of the vibration unit 30 to prevent deviation.

It is worth mentioning that when the suspension edge 20 has a circular shape, the inner side elastic ribs 212 and the outer side elastic ribs 222 are arranged a radial direction, and the inner side elastic ribs 212 are arranged in a circumferential direction and the corresponding outer side elastic ribs 222 are arranged along the circumferential direction. Of course the suspension edge 20 can have another annular shape, such as square ring, oval ring, triangular or other multilateral annular ring and so on.

In other words, the speaker makes the vibration unit 30 only to move along its axial direction by the restriction effect of the inner side elastic ribs 212 and the outer side elastic ribs 222 so as to prevent the vibration unit 30 vibrating air to reproduce noises. Thus, the speaker of the present invention does not need to provide the elastic wave member (center support) of the conventional speaker. Thus, the voice coil 40 of the speaker of the present invention has a shortened distance to an inner surface of the supporting frame 10 so as to form a more compact structure. In addition, as the voice coil 40 and the inner surface of the supporting frame 10 has the shortened distance, the space of the voice coil 40 deviating from its axial direction is correspondingly reduced so as to effectively prevent shaking of the voice coil 40 with a large degree of convergence deviating from its axial direction. In other words, the power of the speaker is effectively applied on the reciprocating axial movement of the voice coil 40 in response to an input of audio signals and will not be wasted without deviating to surroundings. It is worth mentioning that a connecting end which is the voice coil 40 connected to the vibration unit 30 has a shortened distance with the magnetic loop unit 50, while at the same time to ensure that the vibration unit 30 reaches a needed amplitude, so that the space of the voice coil 40 is under control to prevent hitting other components and shaking.

It is worth mentioning that each inner side elastic rib 212 do not have to be integrally connected to the outer side elastic ribs 222 to form an integral elastic ribs. As shown FIG. 10, an outer edge of the inner suspension edge portion 21 and an inner edge of the outer suspension edge portion 22 are integrally connected to form a connection edge 24, which are disposed to form an annular connection edge 24 between the inner suspension edge portion 21 and the outer suspension edge portion 22. As shown in FIG. 1, take the vertically placed speaker as an example, the inner suspension edge portion 21 and the outer suspension edge portion 22 are integrally connected to form an upward arch-shaped structure. As shown FIG. 10, the connection edge 24 extends along a peak which is formed between the inner suspension edge portion 21 and the outer suspension edge portion 22, and the inner side elastic ribs 212 and the outer side elastic ribs 222 are respectively positioned at two sides of the connection edge 24.

Thus, stress of each inner side elastic ribs 212 will not be directly transmitted to the corresponding outer side elastic ribs 222 and will be blocked by the connection edge 24. So, when the vibration unit 30 moves along the axial direction, such as when the vibration unit 30 moves upwardly from its initial position, the inner side elastic ribs 212 prevent the vibration unit 30 deviating from its axial direction, while elastic stress of the inner side elastic ribs 212 will not be transferred to the corresponding outer side elastic ribs 222 and reach the supporting frame 10. Therefore, the supporting frame 10 applies a pulling force on the vibration unit 30 to decrease axial displacement.

In other words, the suspension edge 20 not only prevents the vibration unit 30 form shaking and deviating, but also ensures that the vibration unit 30 has a sufficiently large vibration amplitude which is an enough longer axial displacement so as to ensure that the stroke of the vibration unit 30 is able to reproduce ideal bass.

In this embodiment of the present invention, the connection edge 24 has a blocking effect in the middle, so that the inner side elastic ribs 212 of the corresponding outer side elastic ribs 222 are not directly connected together to form an integral elastic rib. In other words, the vibration unit 30 is guaranteed to have a sufficiently large amplitude.

In addition, as there is no elastic wave member of the conventional speaker, the voice coil 40 only connects to the vibration unit 30 and is arranged only to applied on a pulling force of the vibration unit 30 instead of being applied on a pulling force of the suspension of the conventional speaker, so that the voice coil 40 is able to effectively apply an electromagnetic driver force of the magnetic loop unit 50 on its axial direction displacement. Therefore, the magnetic strength of the magnetic loop unit 50 will not be wasted, so that comparing with the conventional speaker, when the magnetic loop unit 50 has a same amplitude, the size of the desired magnet of the magnetic loop unit 50 will be smaller and more cost will be saved.

The shapes of protrusions which is formed by the inner side elastic ribs 212 and the outer side elastic ribs 222 are unrestricted and the grooves formed on other side also have various shapes. For example, the shapes of the cross-sections of the bulge 2121 of the inner side elastic ribs 212 and the protrusion 2221 of the outer side elastic ribs 222 are bow, arch, triangular, quadrangular, polygonal, semicircular, semi oval, inverted U-shaped, inverted V-shaped and so on. The shapes of the cross-sections of the flute 2122 of each of the inner side elastic ribs 212 and the groove 2222 of each of the outer side elastic ribs 222 are bow, arch, triangular, quadrangular, polygonal, semicircular, semi oval, inverted U-shaped, inverted V-shaped and so on.

In the preferred embodiment of the present invention, each inner side elastic ribs 212 comprises a first section 2123 and a second section 2124. The first section 2123 and the second section 2124 are outwardly protruded relative to the inner suspension edge body 211 and are connected with each other in the middle part to form the flute 2122 on other side. In the preferred embodiment of the present invention, the inner side elastic ribs 212, the first section 2123, the second section 2124 and the inner suspension edge body 211 can have a same thickness and are integrally extended. As shown in the embodiment of the FIG. 2, each of the inner side elastic ribs 212 comprise the first section 2123 in the left and the second section 2124 in the right, so that the entire inner side elastic ribs 212 are archly provided and a connection part in the middle of the first section 2123 and the second section 2124 is the highest point of the arched structure. In addition, the inner side elastic ribs 212 have increased height and width along the suspension edge 20 from an inside-to-outside direction.

The outer side elastic ribs 222 have the similar structure with the above inner side elastic ribs 212, in this embodiment of the present invention, each inner side elastic ribs 212 form a hemispherical convex shape and has a semi-round shaped cross section. It is worth mentioning that the outer edges of the outer side elastic ribs 222 are connected to the supporting frame 10. Alternatively, the outer side elastic ribs 222 do not connected to the supporting frame 10. In other words, the outer side elastic ribs 222 are provided in the middle of the outer suspension edge body 221 and the outer suspension edge portion 22 are connected to the supporting frame 10 by the outer suspension edge body 221.

It is worth mentioning that the supporting frame 10 of the present invention in this embodiment comprises a first support frame 11 and a second support frame 12. The first support frame 11 is connected to the suspension edge 20 and the second support frame 12 is mounted with the magnetic loop unit 50 and other components. Take the speaker as an example, the first support frame 11 of the supporting frame 10 is an upper supporting frame and the second support frame 12 is a lower supporting frame. The first support frame 11 and the second support frame 12 can be combined in various ways, such as lock components, screw elements, heat-melt, ultrasonic joining and so on. In this preferred embodiment of the present invention, the first support frame 11 comprises a plurality of positioning tongues 111, and the second support frame 12 has a positioning grooves 121. Each positioning tongues 111 is arranged for inserting into corresponding positioning groove 121, so that the first support frame 11 is assembled with the second support frame 12. Of course, one skilled in the art will understand that the positioning tongues 111 can be provided on the second support frame 12 and the positioning grooves 121 are formed in the first support frame 11. The first support frame 11 and the second support frame 12 can also respectively have the positioning tongues 111 and the positioning grooves 121.

As shown in FIG. 6, the first support frame 11 has an engaging groove 112. The suspension edge 20 further comprises a connecting brim 25 as a peripheral connecting brim received in the engaging groove 112, so that the suspension edge 20 and the first support frame 11 are connected with each other. The suspension edge 20 can be made of an elastic material and be formed by injection molding. In other words, when the elastic material is forming the inner suspension edge portion 21 and the outer suspension edge portion 22, the connecting brim 25 is integrally formed around the outer suspension edge portion 22 at the same time. The connecting brim 25 is coated on the outer surface of the first support frame 11, so that the suspension edge 20 is connected with the first support frame 11. In this preferred embodiment, during a coating process, the liquid elastic material is flowed into the annular engaging groove 112 so as to form the annular connecting brim 25.

Figure 7:
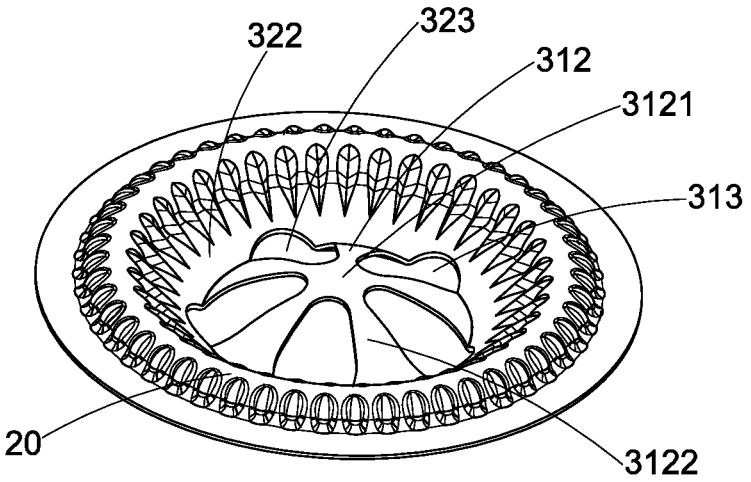
FIG. 7 is a top schematic view of the suspension edge according to above fifth preferred embodiment of the present invention.
Figure 9:
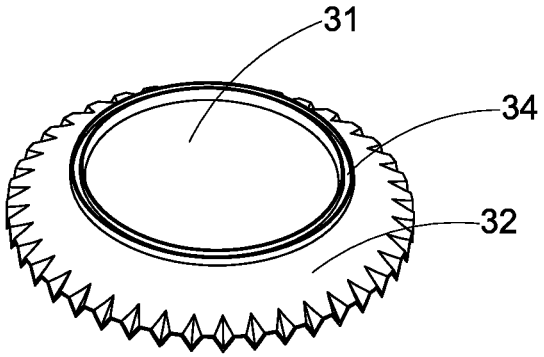
FIG. 9 is a bottom schematic view of the diaphragm according to above fifth preferred embodiment of the present invention.

As shown in FIG. 7 to FIG. 9, the present invention provides a new diaphragm comprising the vibration unit 30 in the middle and the suspension edge 20 on the outer side. The vibration unit 30 comprises the first center portion 31 in the middle and the second surrounding portion 32 connecting with the first center portion 31. The second surrounding portion 32 surrounds the first center portion 31 and forms an annular groove 33 between the first center portion 31 and the second surrounding portion 32.

As shown in FIG. 9, the first center portion 31 comprises a body portion 311. An outer periphery 3111 of the body portion 311 and an inner periphery 3211 of an annular body 321 of the second surrounding portion 32 are provided at an interval to form a mounting groove therebetween. One end of the voice coil 40 is mounted in the mounting groove. In other words, the first center portion 31 and the second surrounding portion 32 of the vibration unit 30 of the present invention are connected in such a way to form the mounting groove for mounting the voice coil 40 on one side, so that it is easy to install. In the conventional art, a flute is needed to be provided on the back of the diaphragm. The diaphragm of the present invention is formed at the joining of the two parts, thereby making the process simpler.

The vibration unit 30 further comprises one or more first connecting portions 312 and one or more second connecting portions 322. The first connecting portions 312 and the second connecting portions 322 are made of the same materials with the suspension edge 20 or are made of the different materials with the body portion 311 and the annular body 321. In other words, during the manufacturing process, the liquid molding materials form the suspension edge 20 by injection molding process, at the same time the body portion 311 of the first center portion 31 and an outer surface of the annular body 321 are coated with the liquid molding materials, thereby having an effect on connecting the suspension edge 20 and the first center portion 31.

Figure 10:
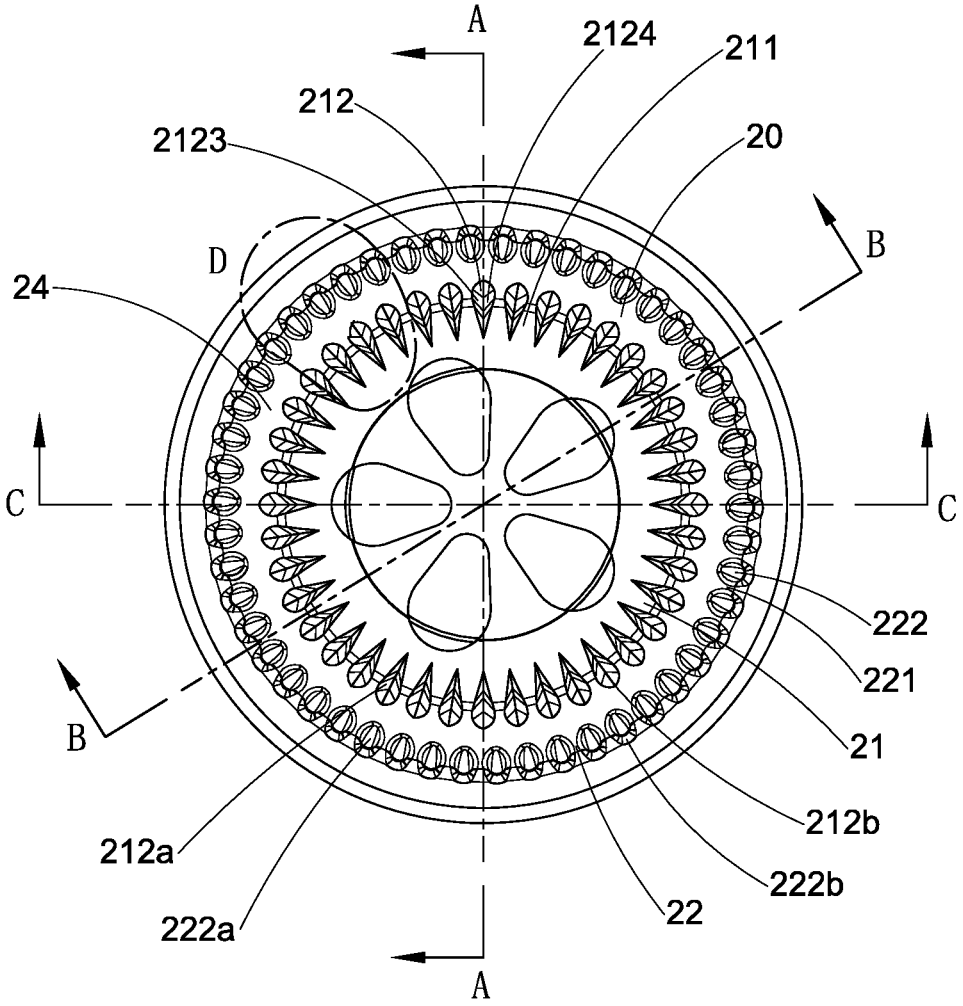
FIG. 10 is a top view of the suspension edge and the diaphragm according to above fifth preferred embodiment of the present invention.
Figure 11:
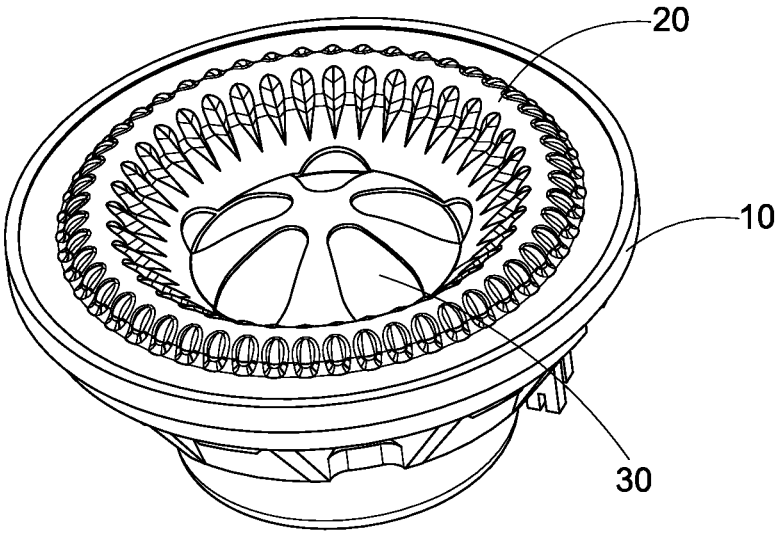
FIG. 11 is a perspective view of a speaker assembled the diaphragm according to above fifth preferred embodiment of the present invention.

It is worth noting that the first connecting portions 312 can be arranged at intervals so as to form a plurality of first openings 313 therebetween. The first openings 313 can be formed around a circumferential direction. As shown in FIG. 9 to FIG. 11, the first connecting portions 312 can form a petal shape so as to enhance the aesthetic appearance and to save materials. In this preferred embodiment, the first connecting portions 312 comprise a middle connecting portion 3121 in the middle and five periphery portions 3122 extended at intervals from the middle connecting portion 3121.

The second connecting portions 322 are arranged at intervals to form a plurality of second openings 323 therebetween. The second openings 323 can be formed around a circumferential direction.

It is worth mentioning that the first connecting portions 312 can be integrally connected with the corresponding second connecting portions 322, so that each corresponding first opening 313 form an integral opening with each corresponding second opening 323. In other words, the first openings 313 formed at the inside first center portion 31 are correspondingly extended into the outside second openings 323 of the second surrounding portion 32.

The suspension edge 20 and the vibration unit 30 can be made of different materials, for example, the suspension edge 20 is made of soft materials of the vibration unit 30. Thus, the integral configuration of the suspension edge 20 and the vibration unit 30 are provided such these first openings 313 and second openings 323 without filling these materials, thereby equivalently combining with the hard and soft materials and effectively preventing a quick transmission of the pulling stress force and producing a uniform dispersion effect, so that the vibration unit 30 vibrates more regularly.

It is worth mentioning that the first center portion 31 is formed in a cap-shape and can also include a dust cap structure. In the actual needs, the body portion 311 of the first center portion 31 also comprises a heavier blocks, such as aluminum iron, copper and so on. The annular body 321 of the second surrounding portion 32 obliquely extends from the outer periphery 3111 of the first center portion 31 to the surroundings and has a gradually increased diameter so as to form a similar tapered structure.

As shown in FIG. 6, the second surrounding portion 32 comprises a plurality of connect section 324 annularly arranged at intervals. The connect sections 324 are protruded relative to the annular body 321 to correspondingly install into the periphery portions 3122 formed by the first connecting portions 312 of the first center portion 31. It is worth mentioning that the size of the connect section 324 corresponds to the size of the periphery portions 3122 and it size of the connect section 324 can be smaller to the corresponding periphery portions 3122.

Figure 18:
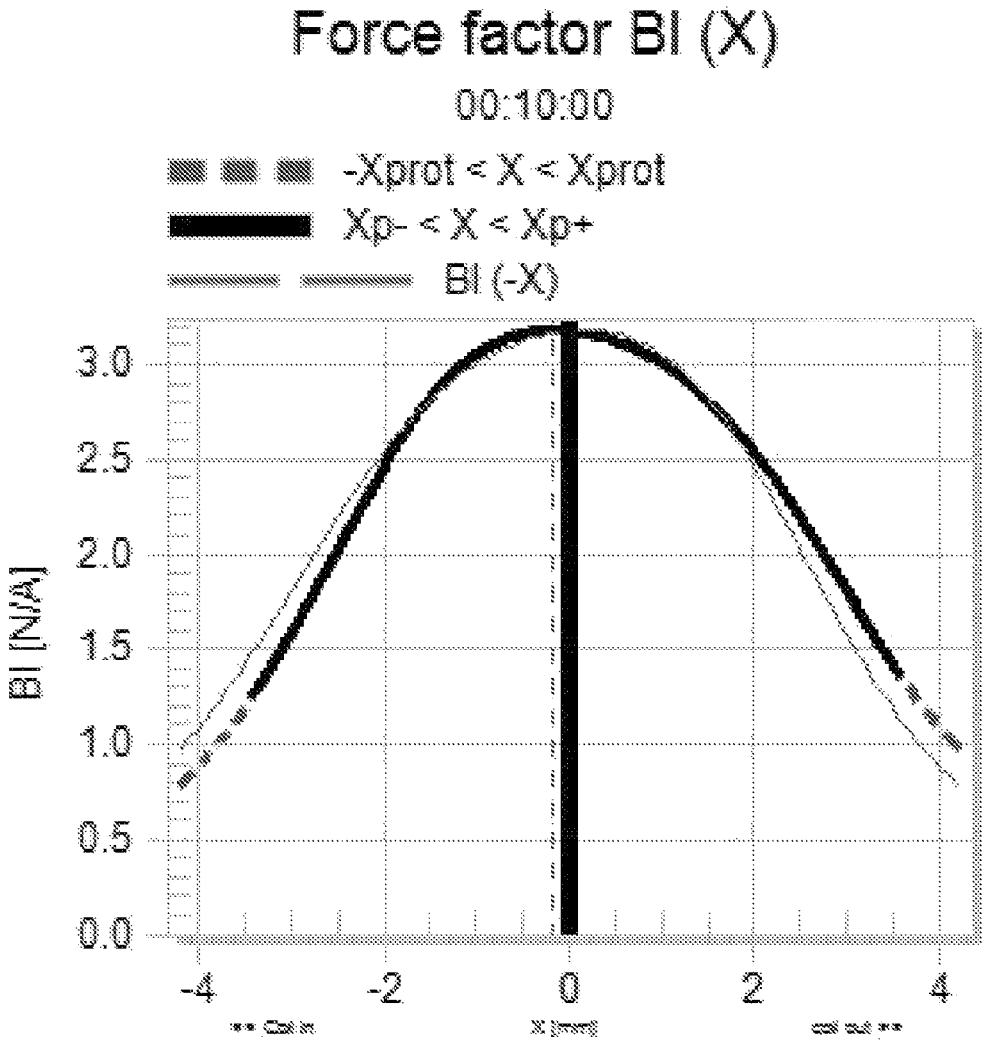
FIG. 18 and FIG. 19 are testing results of the magnetic force factor BL in the magnetic hysteresis of the speaker according to above fifth preferred embodiment of the present invention.
Figure 19:
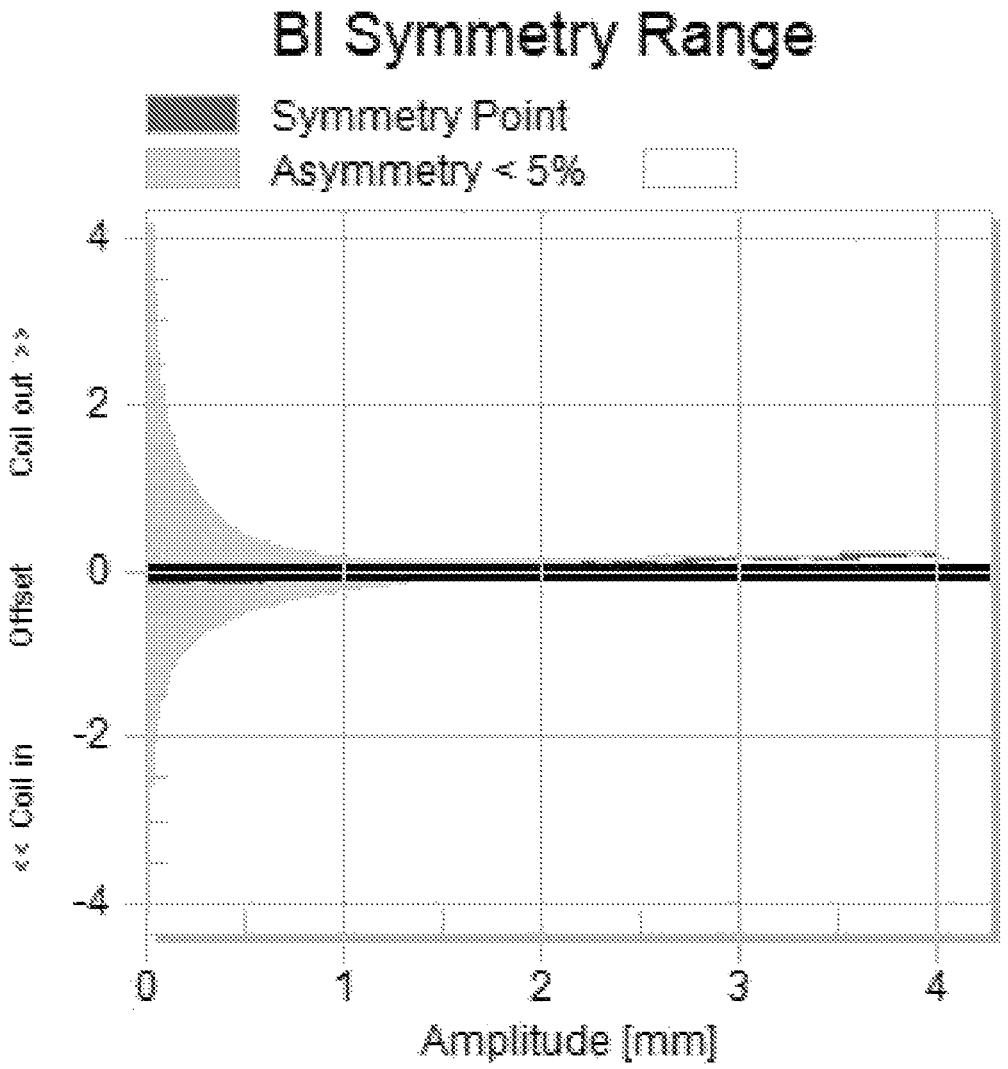
Figure 20:
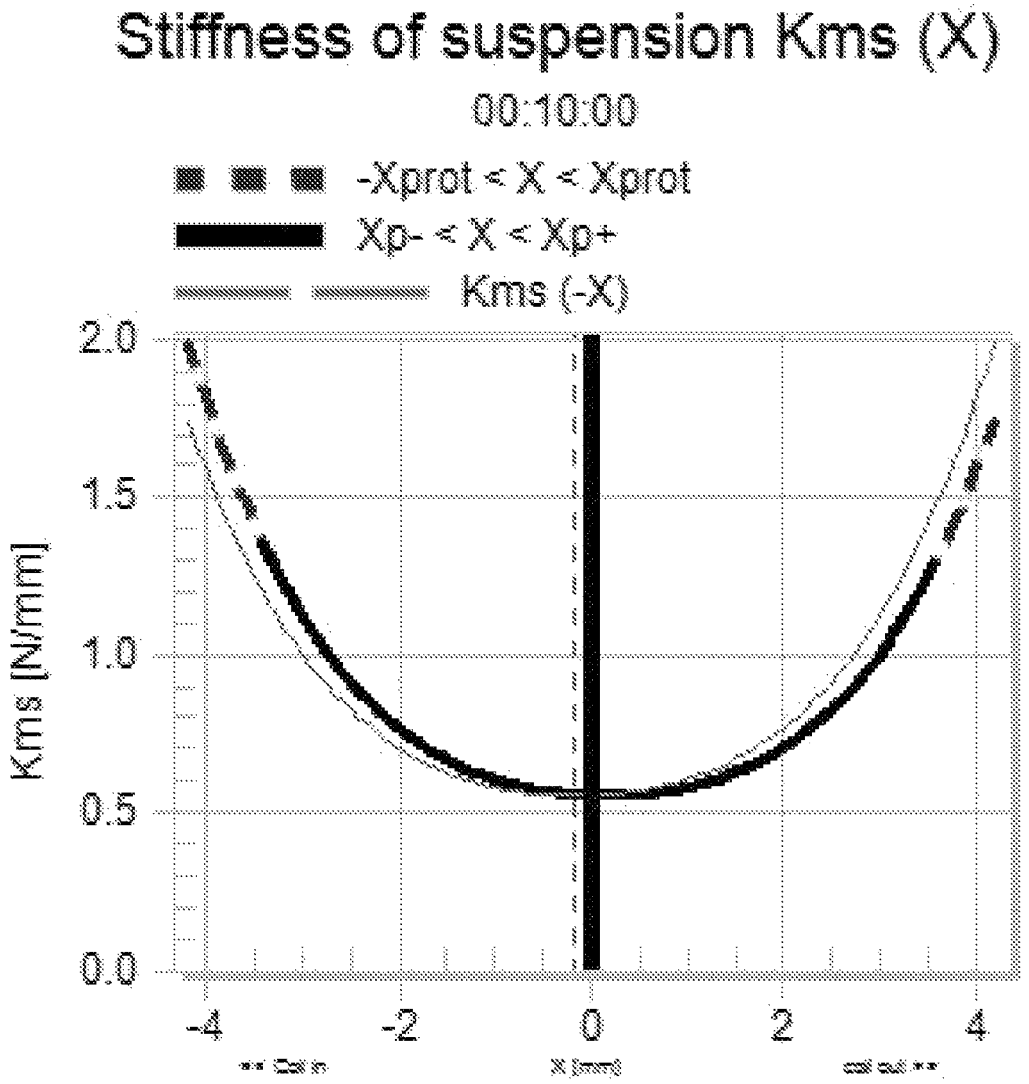
FIG. 20 and FIG. 21 are testing results of the compliance performance of the speaker according to above fifth preferred embodiment of the present invention.
Figure 21:
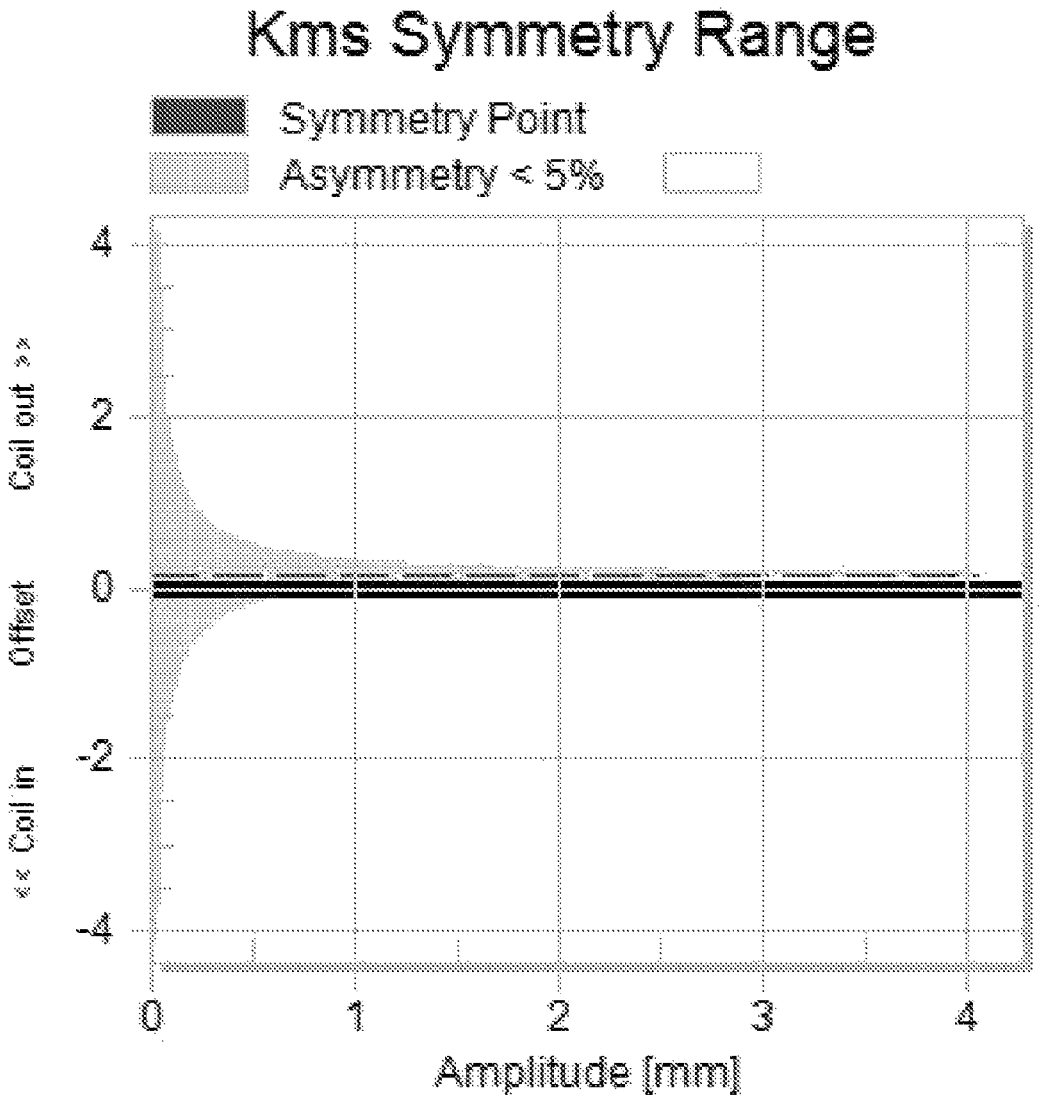
Figure 22:
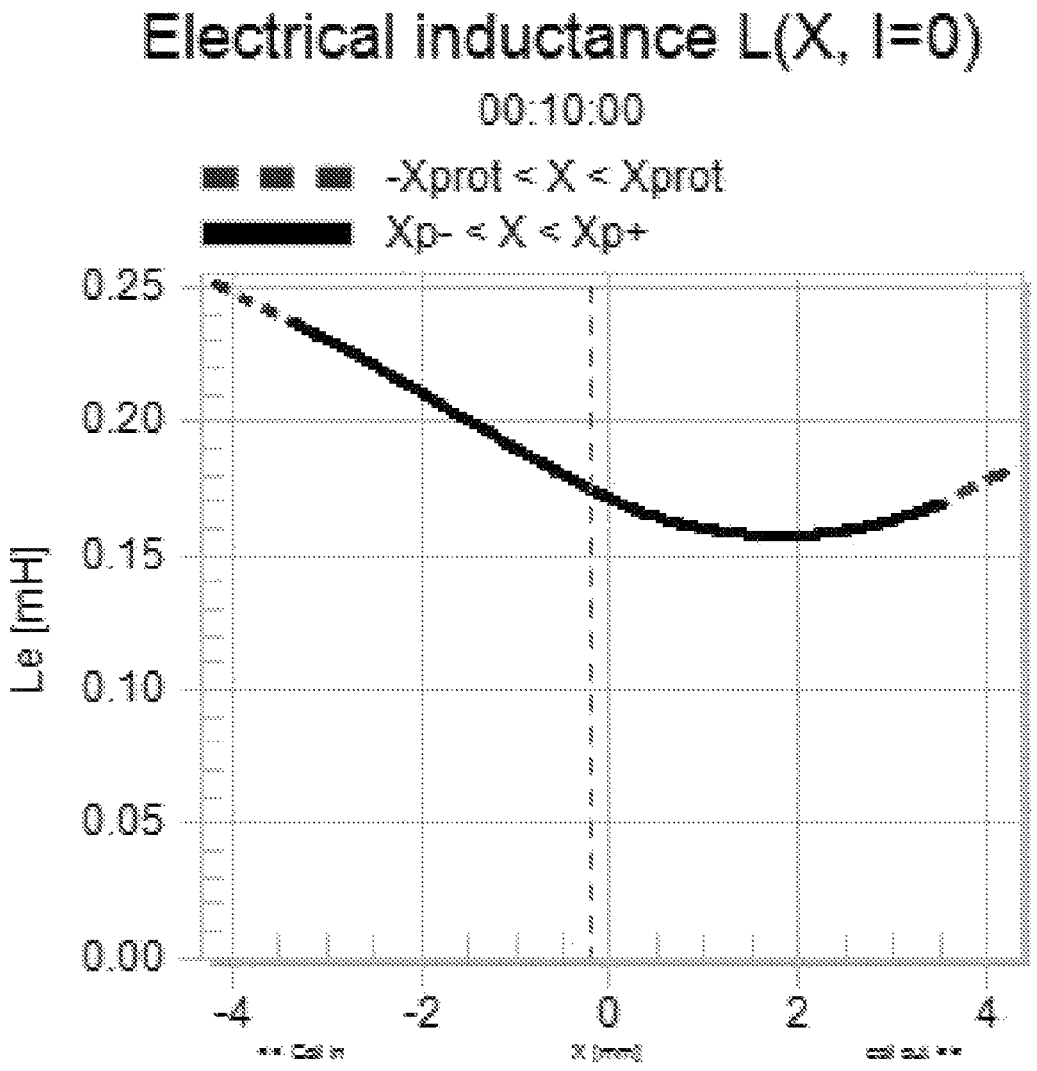
FIG. 22 is a testing result of the voice coil inductance value of the speaker according to above fifth preferred embodiment of the present invention.
Figure 23:
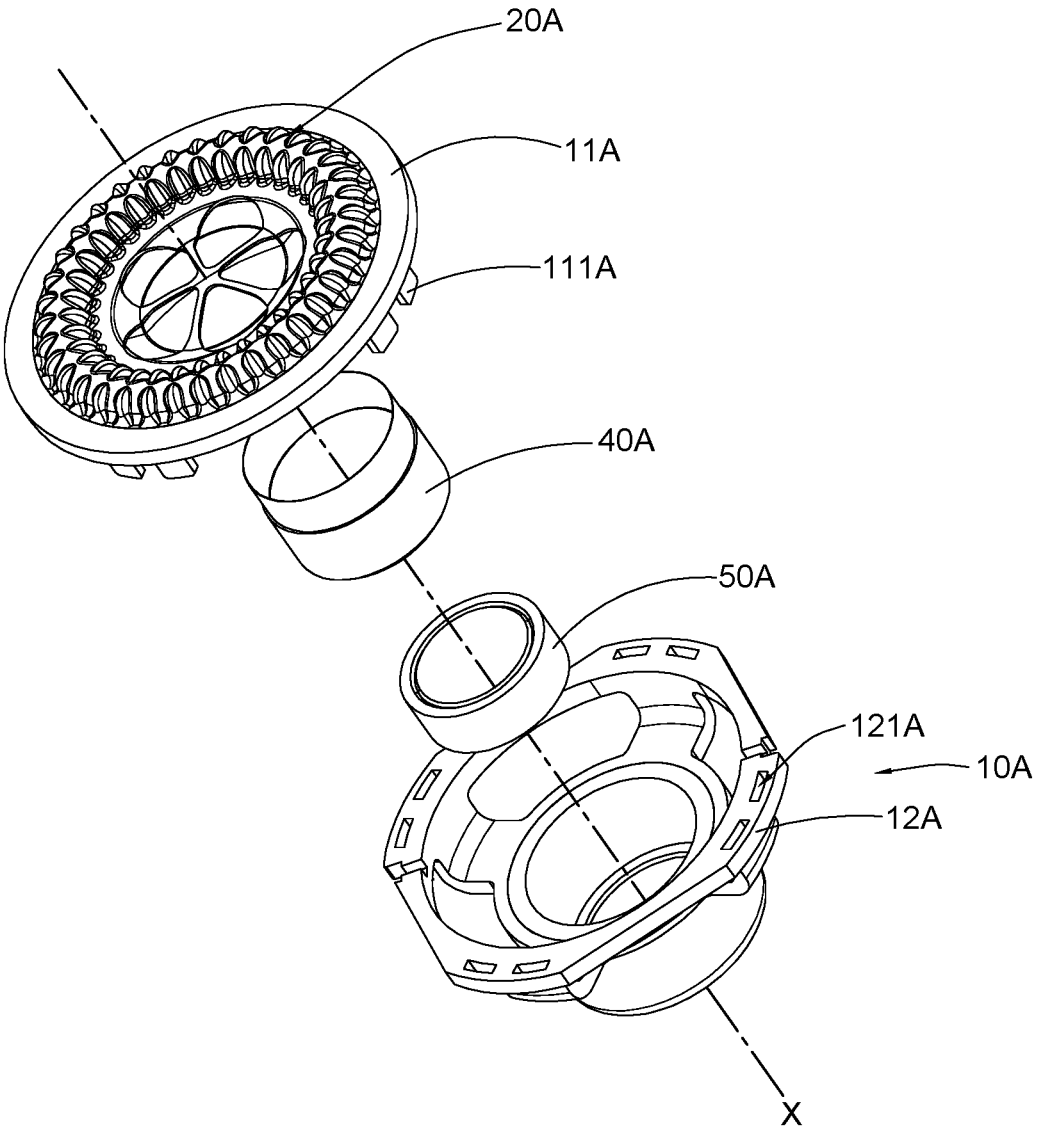
FIG. 23 is an exploded schematic view of a speaker with a suspension edge according to a sixth preferred embodiment of the present invention.
Figure 24:
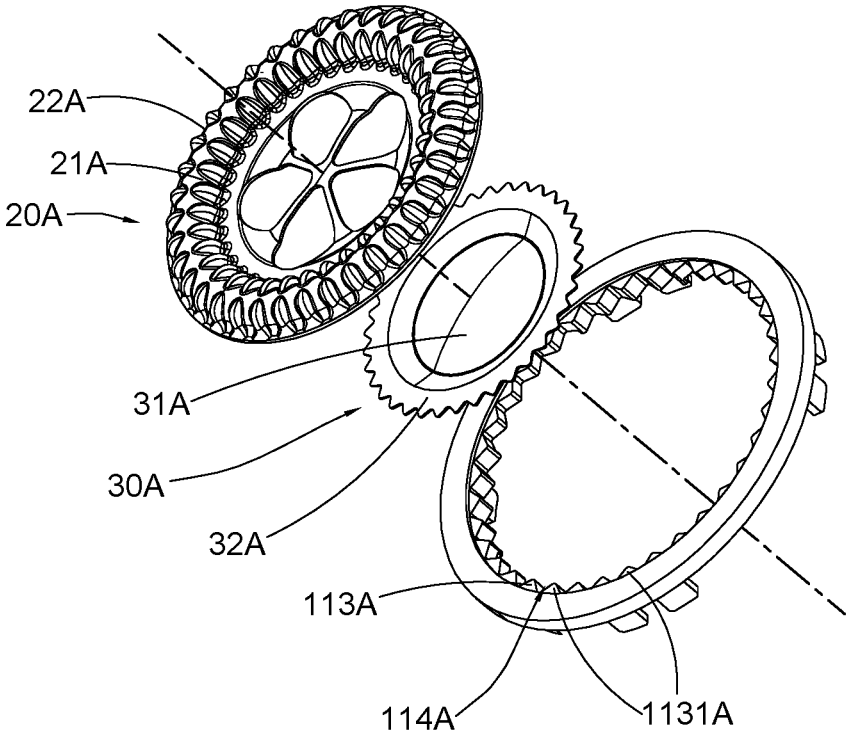
FIG. 24 is an exploded schematic view of the suspension edge having elastic ribs and a vibration unit and a supporting frame according to the sixth preferred embodiment of the present invention.
Figure 25:
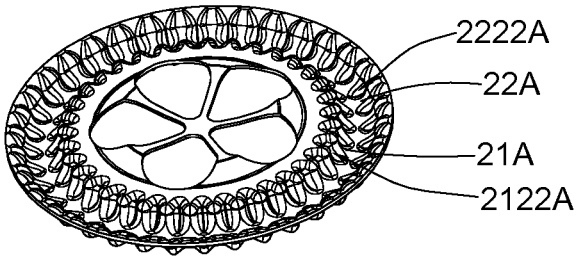
FIG. 25 is a bottom perspective view of the suspension edge having elastic ribs according to above sixth preferred embodiment of the present invention.
Figure 26:
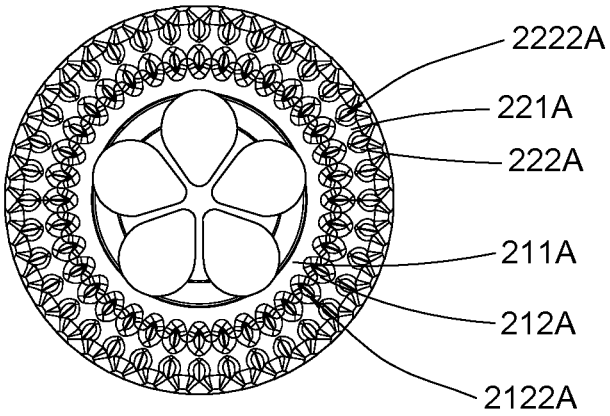
FIG. 26 is a bottom top view of the suspension edge having elastic ribs according to above sixth preferred embodiment of the present invention.
Figure 27:
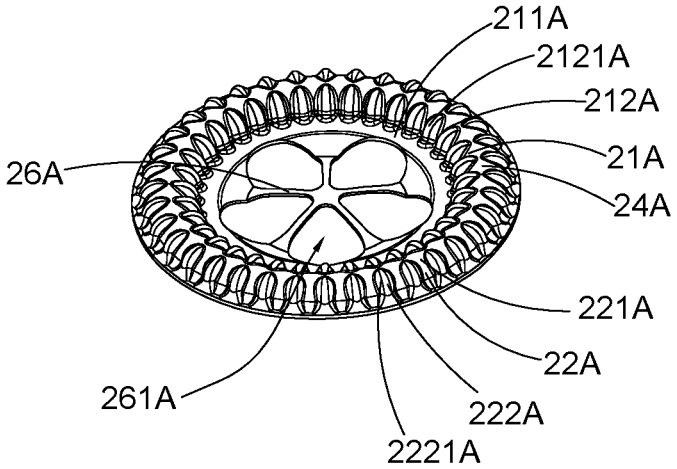
FIG. 27 is a top perspective view of the suspension edge having elastic ribs according to above sixth preferred embodiment of the present invention.
Figure 28:
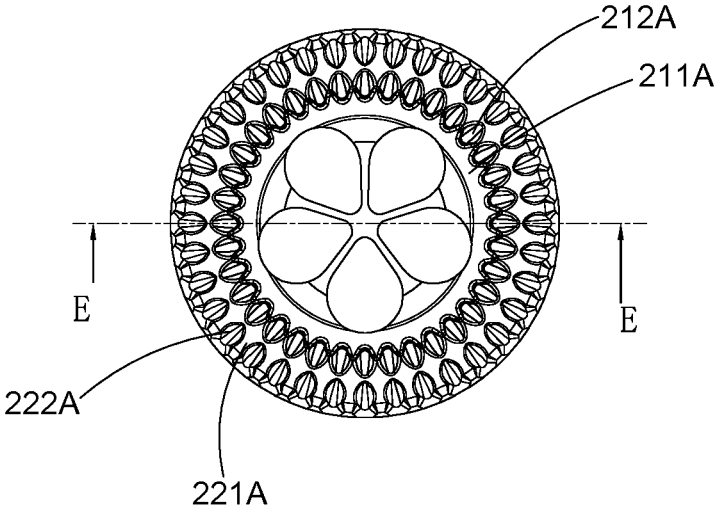
FIG. 28 is a top view of the suspension edge having elastic ribs according to above sixth preferred embodiment of the present invention.
Figure 29:
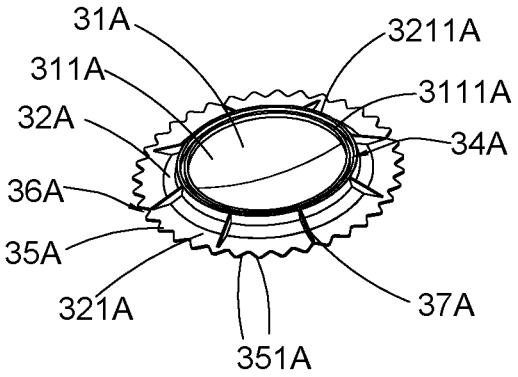
FIG. 29 is a bottom schematic view of the vibration unit of the speaker according to above sixth preferred embodiment of the present invention.
Figure 30:
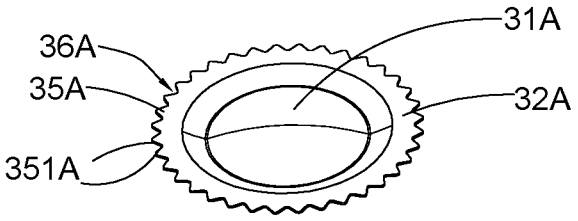
FIG. 30 is a top schematic view of the vibration unit of the speaker according to above sixth preferred embodiment of the present invention.
Figure 31:
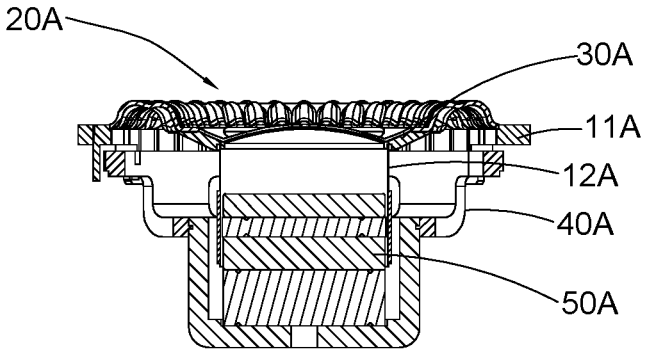
FIG. 31 is a sectional section view of the speaker according to above sixth preferred embodiment of the present invention.
Figure 32:
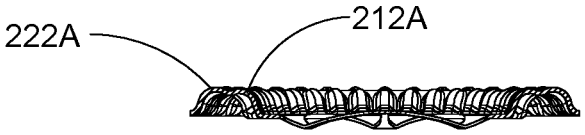
FIG. 32 is a sectional view of the suspension edge having elastic ribs according to above sixth preferred embodiment of the present invention.
Figure 33:
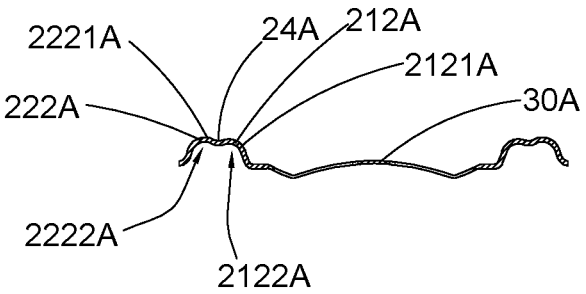
FIG. 33 is a cross sectional view of the suspension edge having elastic ribs according to above sixth preferred embodiment of the present invention.
Figure 34:
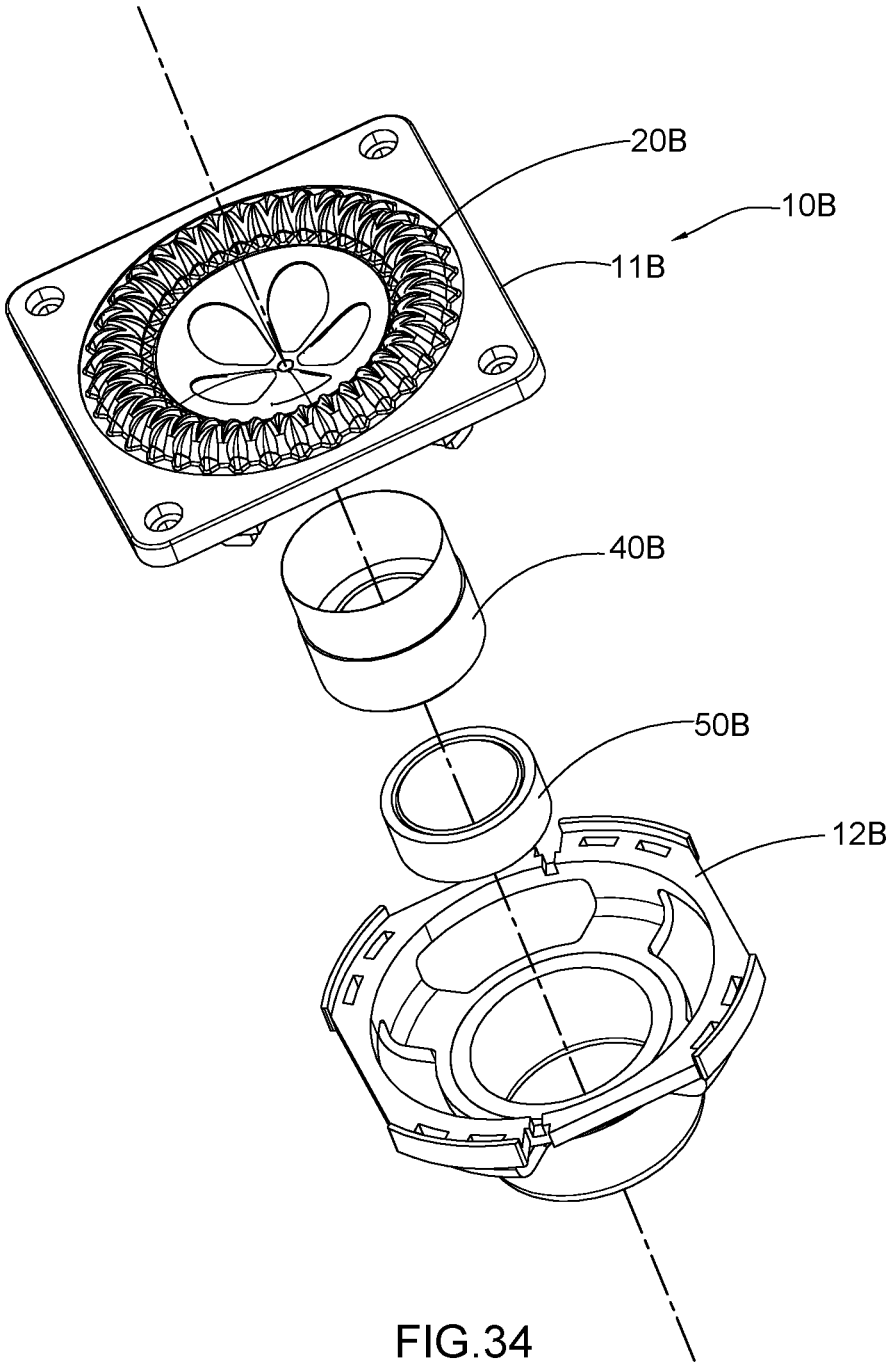
FIG. 34 is an exploded schematic view of a speaker with a suspension edge having elastic ribs according to a seventh preferred embodiment of the present invention
Figure 35:
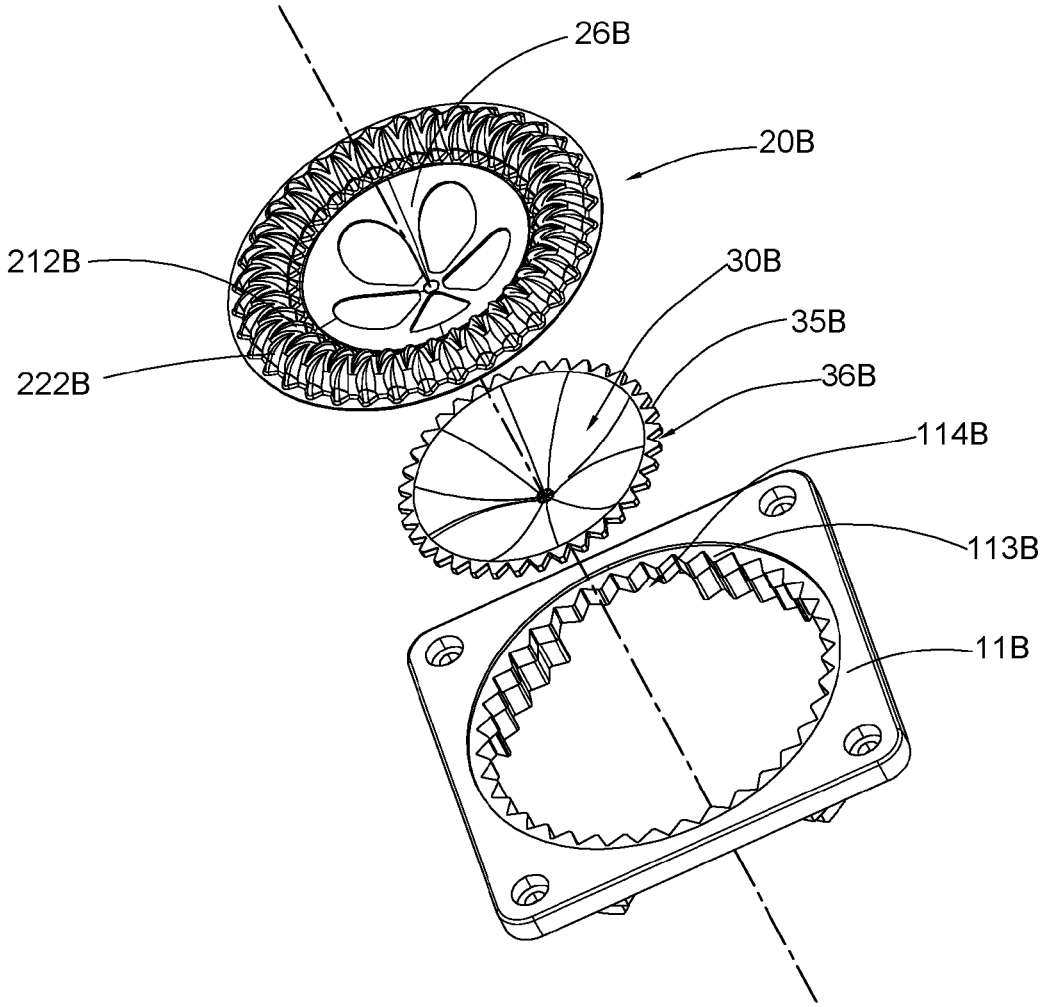
FIG. 35 is an exploded schematic view of the suspension edge having elastic ribs and a vibration unit and a supporting frame according to the seventh preferred embodiment of the present invention.
Figure 36:
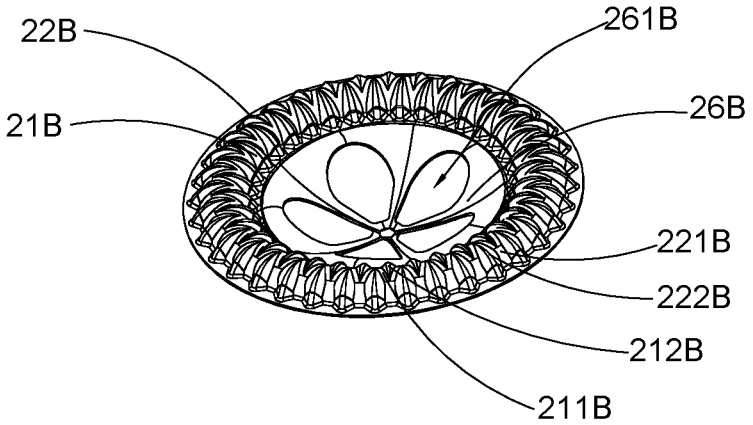
FIG. 36 is a top schematic view of the suspension edge having elastic ribs according to above sixth preferred embodiment of the present invention.
Figure 37:
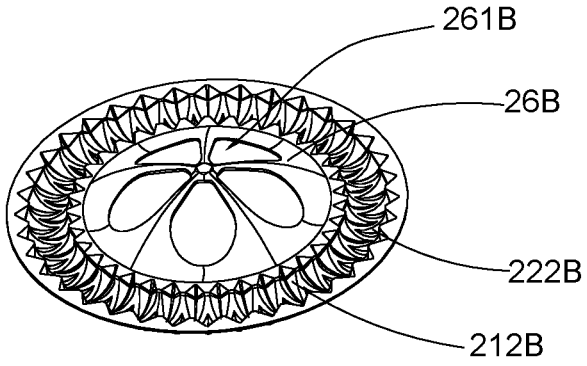
FIG. 37 is a bottom schematic view of the suspension edge having elastic ribs of the speaker according to above seventh preferred embodiment of the present invention.
Figure 38:
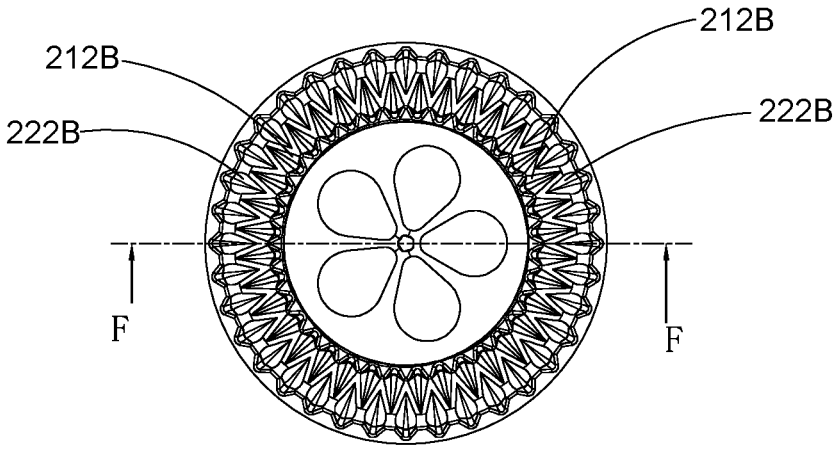
FIG. 38 is a top view of the suspension edge having elastic ribs of the speaker according to above seventh preferred embodiment of the present invention.
Figure 39:
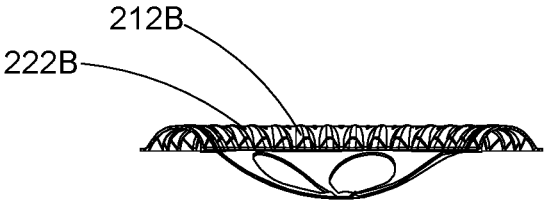
FIG. 39 is a sectional view of the suspension edge having elastic ribs according to above seventh preferred embodiment of the present invention.
Figure 40:
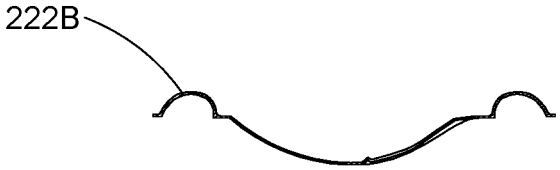
FIG. 40 is a cross sectional view of the suspension edge having elastic ribs according to above seventh preferred embodiment of the present invention.
Figure 41:
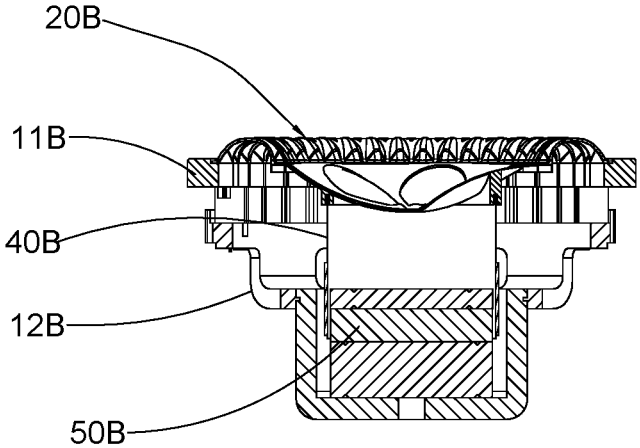
FIG. 41 is a sectional view of the speaker according to above seventh preferred embodiment of the present invention.
Figure 42:
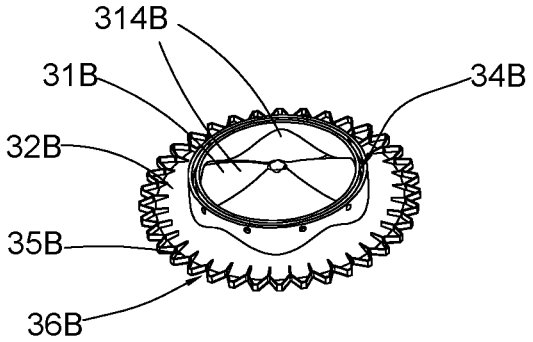
FIG. 42 is a bottom schematic view of the vibration unit of the speaker according to above seventh preferred embodiment of the present invention.
Figure 43:
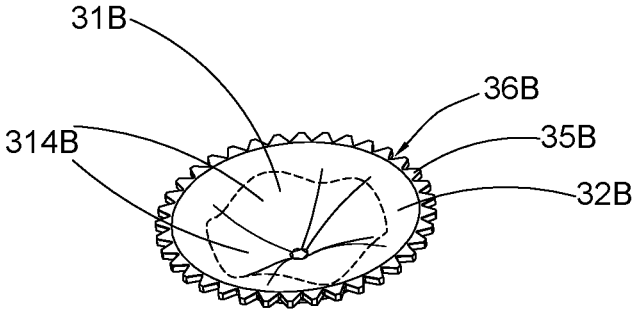
FIG. 43 is a top perspective view of the vibration unit of the speaker according to above seventh preferred embodiment of the present invention.

It is worth mentioning that the speaker with the suspension edge 20 and the diaphragm significantly improves sound quality and reduces sound distortions, as shown in FIG. 18 to FIG. 22. FIG. 18 and FIG. 19 are two presentations of the intensity of magnetism BL. The imaginary line at O-point shows a standard center line and the black full line shows a voice coil center point. The drawings illustrate that the magnetic field of the speaker of the present invention is symmetric and the voice coil is in the saturation magnetic field. FIG. 20 and FIG. 21 show the speaker compliance (Cms) and the Kms equals 1/Cms in the drawings. Accordingly, the suspension edge 20 of the present invention has a better symmetry. FIG. 22 shows a changing curve of the voice coil inductance value, wherein the O-point is a standard center line. It can be seen that the voice coil inductance value of the speaker changes smooth with the displacement. Thus the non-suspension speaker can effectively prevent sounds distortion.

Referring to FIG. 23 to FIG. 33 of the drawings, an assembled speaker with a suspension edge 20A having elastic ribs and a diaphragm according to a sixth preferred embodiment of the present invention is illustrated. The speaker comprises a supporting frame 10A, a suspension edge 20A, a vibration unit 30A, a 40A, a 50A and other desired components.

In this preferred embodiment, the first support frame 11A comprises a plurality of wave-shaped protruding teeth 113A annularly and inwardly protruded at the radial direction. An indented groove 114A is formed between two adjacent protruding teeth 113A. The outer side elastic ribs 222A are extended from an external edge 1131A of the protruding teeth 113A and outwardly extended from two adjacent protruding teeth 113A. Preferably, each protruding tooth 113A has a triangular cross-section. One skilled in the art will understand that the cross-sections can be other suitable shapes, such as square, trapezoid, semicircle and so on. Thus, the outer side elastic ribs 222A are firmly connected to the first support frame 11A and has a longer length along a radial direction relative to other outer suspension edge body 221A so as to enhance the restricting effect of the outer side elastic ribs 222A.

The vibration unit 30A comprises a cap portion 31A (the first center portion) in the middle and a skirt portion 32A (the second surrounding portion) connected to the cap portion 31A. The skirt portion 32A surrounds the cap portion 31A and forms an annular groove 33A between the cap portion 31A and the skirt portion 32A.

The cap portion 31A comprises a body portion 311A. An outer periphery 3111A of the body portion 311A and an inner periphery 3211A of an annular body 321A of the skirt portion 32A are provided at an interval to form a mounting groove 34A therebetween. In other words, the cap portion 31A and the skirt portion 32A of the vibration unit 30A of the present invention are connected in such a way to form the mounting groove 34A for mounting the 40A on one side, so that it is easy to install.

It is worth mentioning that the cap portion 31A has a cap-shape and can also include a dust cap structure. In the actual needs, the body portion 311A of the cap portion 31A also comprises a heavier blocks, such as aluminum iron, copper and so on. The annular body 321A of the skirt portion 32A obliquely extends from the outer periphery 3111A of the cap portion 31A to the surroundings and has a gradually increased diameter so as to form a similar tapered structure.

The vibration unit 30A comprises a plurality of wave-shaped convex teeth 35A outwardly arranged along a circumferential direction. A notch 36A is formed between two adjacent convex teeth 35A. The inner side elastic ribs 212A are extended from the outer edges 351A of the convex teeth 35A and outwardly extended from two adjacent convex teeth 35A. Preferably, each of the convex teeth 35A has a triangular cross-section. One skilled in the art will understand that the cross-sections can be other suitable shapes, such as square, trapezoid, semicircle and so on. Thus, the inner side elastic ribs 212A are firmly connected to the vibration unit 30A and has a longer length along a radial direction relative to other inner suspension edge body 211A so as to enhance the restricting effect of the outer side elastic ribs 222A.

In other words, both sides of the suspension edge 20A are provided between the vibration unit 30A and the first support frame 11A in such a way, so that the outer side elastic ribs 222A and the inner side elastic ribs 212A both enhance elastic restricting performances. The skirt portion 32A also comprises a plurality of enhancing ribs 37A radially arranged at the bottom side thereof, thereby further enhancing the axial movement performance of the vibration unit 30A.

In other words, preferably, the elastic ribs are both arranged on two side edges of the suspension edge 20A so as to form a jagged or wavy edges. It is worth mentioning that the convex teeth 35A and the protruding teeth 113A can be solid or be hollow (such as forming a groove on other surface), as long as the convex teeth 35A and the protruding teeth 113A are extended from the outer wall of the vibration unit 30 or the inner wall of the first support frame 11A.

Referring to FIG. 34 to FIG. 43 of the drawings, a suspension edge 20B with elastic ribs and a speaker thereof according to a seventh preferred embodiment of the present invention is illustrated. The suspension edge 20B in this seventh preferred embodiment has a similar structure with the suspension edge 20 in the first preferred embodiment. The suspension edge 20B of the present invention comprises an inner suspension edge portion 21B and an outer suspension edge portion 22B. The inner suspension edge portion 21B and the outer suspension edge portion 22B can be integrally formed and annularly surround the vibration unit 30B. The inner suspension edge portion 21B is molded with the outer suspension edge portion 22B and form a fold-shaped, arch-shaped or wavy configuration along a cross-section direction. As shown in FIG. 12, the inner suspension edge portion 21B and the outer suspension edge portion 22B are integrally connected and form an arch-shaped configuration. The inner suspension edge portion 21B and the outer suspension edge portion 22B are respectively positioned two sides of the peak of the arch-shaped configuration.

In this preferred embodiment of the present invention, the inner suspension edge portion 21B of the suspension edge 20B comprises an inner suspension edge body 211B and a plurality of inner side elastic ribs 212B. The inner side elastic ribs 212B are spaced and arranged along a circumferential direction. The inner side elastic ribs 212B are integrally and protruding extended from the inner suspension edge body 211B.

Two adjacent inner side elastic ribs 212B are provided at interval and the plurality of inner side elastic ribs 212B are radially arranged so as to restrict the displacement direction of the suspension edge 20B in an axial direction. Specifically, when the suspension edge 20B is about to have a displacement in a predetermined deviating axial direction, the inner side elastic ribs 212B in an opposite direction will have a restricting effect to prevent a further deviation of the suspension edge 20B.

The outer suspension edge portion 22B comprises the outer suspension edge body 221B and the outer side elastic ribs 222B. The outer side elastic ribs 222B are spaced and arranged along a circumferential direction. The outer side elastic ribs 222B are integrally and convexly extended from the outer suspension edge body 221B. Similarly, two adjacent outer side elastic ribs 222B are provided at interval and the outer side elastic ribs 222B are radially and evenly arranged so as to restrict the displacement direction of the suspension edge 20B in the axial direction.

Figure 16:
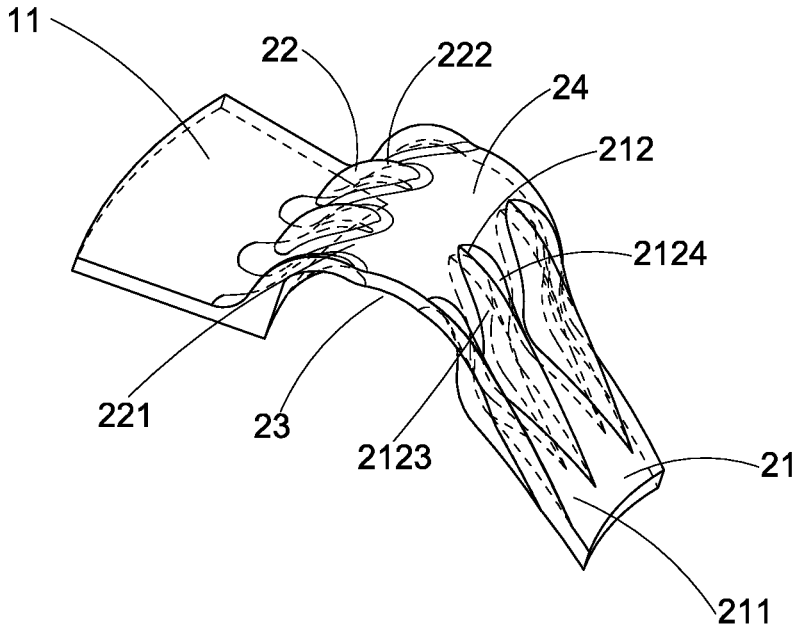
FIG. 16 is an enlarged schematic view of the FIG. 10 at a position of D.
Figure 17:
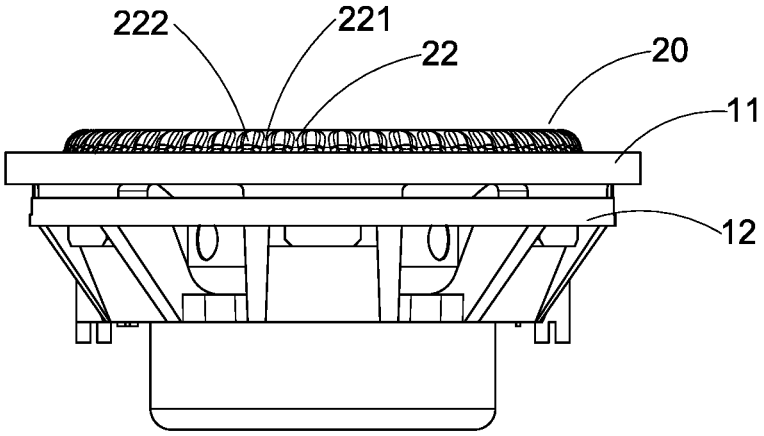
FIG. 17 is a side perspective view of the speaker according to above fifth preferred embodiment of the present invention.

In this preferred embodiment, the adjacent inner side elastic ribs 212B and the outer side elastic ribs 222B are not aligned and have a misplaced arrangement. As shown in FIG. 14 to FIG. 16 according to the preferred embodiment, when the vibration unit 30B is substantially circular and the suspension edge 20B is correspondingly circular, the adjacent inner side elastic ribs 212B and the outer side elastic ribs 222B are not arranged in different radial directions instead of the same radial direction, thereby forming a misplaced configuration. Thus, the inner side elastic ribs 212B and the outer side elastic ribs 222B respectively play a role of restricting to reduce impacts of each other, and this displaced arrangement enhances entire elastic recovery performance of the inner suspension edge portion 21B and outer suspension edge portion 22B. As shown in the drawings, two adjacent inner side elastic ribs 212B and one outer side elastic rib 222B on other side of the peak have a triangular supporting arrangement. Preferably, the inner side elastic ribs 212B correspond to the outer suspension edge body 221B of the inner suspension edge portion 21B and the outer side elastic ribs 222B correspond to the inner suspension edge body 211B of the inner suspension edge portion 21B along a radial direction. Preferably, the 114B of the first support frame 11B and the notch 36B of the vibration unit 30B have a misplaced arrangement.

As shown in the drawings, the cap portion 31B of the vibration unit 30B is not a regular cap-shape and unlike the cap portion top toward an opposite direction of the voice coil and forming arched state, while the cap portion 31B of the vibration unit 30B is formed by a plurality of sections 314B twisty connected with each other along a circumferential direction, such as forming a wavy structure along the circumferential direction and to make the top of the cap portion 31B to arch toward the voice coil. The cap portion 31B of the vibration unit 30B of the multi-stage wavy structure enhances the vibration performance of the vibration unit 30B.

Figure 44:
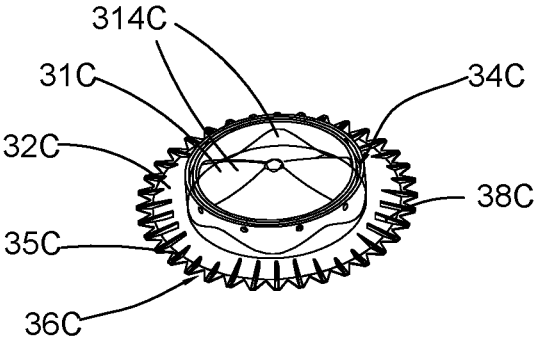
FIG. 44 is a bottom perspective view of the vibration unit of the speaker according to an alternative mode of above seventh preferred embodiment of the present invention.

As shown in FIG. 44, an alternative mode according to the above described embodiment is illustrated. A skirt portion 32C of a vibration unit 30C of the present invention is provided a plurality of reinforcing ribs 38C along a circumferential direction on the side of mounting the voice coil. Preferably, the plurality of reinforcing ribs 38C have a wavy shape along the circumferential direction so as to play a role of restricting similar to the above elastic ribs. The cross sections of the reinforcing ribs 38C are bow, arch, triangular, quadrangular, polygonal, semicircular, semi oval, inverted U-shaped, inverted V-shaped and so on. Preferably, in this alternative mode, the reinforcing ribs 38C and the wave-shaped convex teeth 35C are integrally formed and the wave-shaped convex teeth 35C are integrally extended toward the cap portion 31C so as to play a role of reinforcing.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A suspension edge for a speaker which comprise a vibration unit and a supporting frame, comprising:

an inner suspension edge portion for connecting with the vibration unit, wherein said inner suspension edge portion comprises an inner suspension edge body and one or more inner side elastic ribs radially protruded from said inner suspension edge body, wherein each of said inner side elastic ribs is configured in a convex shape, wherein each of said inner side elastic ribs forms a bulge on a first side of said inner suspension edge portion and a flute on an opposite side thereof; and an outer suspension edge portion for connecting with the supporting frame, wherein said outer suspension edge portion comprises an outer suspension edge body and one or more outer side elastic ribs radially protruded from said outer suspension edge body, wherein each of said outer side elastic ribs forms a protrusion on a first side of said outer suspension edge portion and a groove on an opposite side thereof, wherein said inner side elastic ribs are aligned with said outer side elastic ribs along a radial direction respectively, such that said bulges of said inner side elastic ribs are aligned with said protrusion of said outer side elastic ribs respectively while said flutes of said inner side elastic ribs are aligned with said grooves of said outer side elastic ribs respectively.

2. The suspension edge, as recited in claim 1, wherein said inner suspension edge portion and said outer suspension edge portion are integrally connected and formed an arch-shaped configuration, wherein an annular connection edge forms and extends along a peak which is formed between said inner suspension edge portion and said outer suspension edge portion.

3. The suspension edge, as recited in claim 1, wherein said inner side elastic ribs are integrally extended to said outer side elastic ribs respectively, wherein each of said inner side elastic ribs has an increased height and width along said suspension edge.

4. The suspension edge, as recited in claim 1, further comprising a connection edge integrally extended between said inner suspension edge portion and said outer suspension edge portion, wherein said inner side elastic ribs and said outer side elastic ribs are respectively positioned on two sides of said connection edge respectively, such that said connection edge is adapted to prevent stress directly transmitting from said inner side elastic ribs to said outer side elastic ribs.

5. The suspension edge, as recited in claim 1, wherein said inner side elastic ribs are integrally formed with said inner suspension edge body, wherein each of said inner side elastic ribs comprise a first section at a left side thereof and a second section at a right side thereof, wherein said first section and said second section are integrally connected, wherein each of said inner side elastic ribs is configured to have an arched structure that a connection part of said first section and said second section is the highest point of said arched structure.

6. The suspension edge, as recited in claim 1, further comprising a connecting body integrally extended from said inner suspension edge portion for overlapping on the vibration unit.

7. A diaphragm for a speaker which comprises a voice coil and a supporting frame, comprising:

a vibration unit, which is being moved in its axial direction for sound production, comprising a first center portion and a second surrounding portion provided around said first center portion on one side of said vibration unit and a mounting groove is formed between an outer periphery of said first center portion and an inner periphery of said second surrounding portion for mounting to the voice coil; and a suspension edge, coupled around said vibration unit for connecting to the supporting frame, comprising:

an inner suspension edge portion for connecting with the vibration unit, wherein said inner suspension edge portion comprises an inner suspension edge body and one or more inner side elastic ribs radially protruded from said inner suspension edge body, wherein each of said inner side elastic ribs is configured in a convex shape, wherein each of said inner side elastic ribs forms a bulge on a first side of said inner suspension edge portion and a flute on an opposite side of thereof; and an outer suspension edge portion for connecting with the supporting frame, wherein said outer suspension edge portion comprises an outer suspension edge body and one or more outer side elastic ribs radially protruded from said outer suspension edge body, wherein each of said outer side elastic ribs forms a protrusion on a first side of said outer suspension edge portion and a groove on an opposite side thereof, wherein said inner side elastic ribs are aligned with said outer side elastic ribs along a radial direction respectively, such that said bulges of said inner side elastic ribs are aligned with said protrusion of said outer side elastic ribs respectively while said flutes of said inner side elastic ribs are aligned with said grooves of said outer side elastic ribs respectively.

8. The diaphragm, as recited in claim 7, wherein said first center portion of said vibration unit comprises a body portion and a plurality of first connecting portions, wherein said first connecting portions and said suspension edge are made of same materials and are integrally formed with said suspension edge, wherein a first opening is formed between two adjacent first connecting portions.

9. The diaphragm, as recited in claim 8, wherein said second surrounding portion of said vibration unit comprises an annular body and a plurality of second connecting portions, wherein said second connecting portions and said suspension edge are made of same materials and are integrally formed with said suspension edge, wherein a second opening is formed between two adjacent second connecting portions.

10. The diaphragm, as recited in claim 9, wherein said first openings are communicated with and extended to said second openings respectively to form a plurality of integral openings.

11. The diaphragm, as recited in claim 10, wherein said inner side elastic ribs are aligned with said outer side elastic ribs respectively.

12. The diaphragm, as recited in claim 10, wherein said inner side elastic ribs are integrally extended to said outer side elastic ribs respectively.

13. The diaphragm, as recited in claim 10, further comprising a connection edge integrally extended between said inner suspension edge portion and said outer suspension edge portion, wherein said inner side elastic ribs and said outer side elastic ribs are respectively positioned on two sides of said connection edge respectively.

14. The diaphragm, as recited in claim 10, wherein said inner side elastic ribs are integrally formed with said inner suspension edge body, wherein each of said inner side elastic ribs comprise a first section and a second section integrally connected with said first section in different level surfaces.

15. The diaphragm, as recited in claim 10, further comprising a connecting body integrally extended from said inner suspension edge portion for overlapping on the vibration unit.

16. A speaker, comprising:

a magnetic coil unit;

a voice coil reciprocatingly moving driven by said magnetic coil unit;

a vibration unit coupling with said voice coil and being moved in its axial direction for sound production, wherein said vibration unit comprises a plurality of wave-shaped convex teeth outwardly extended along a circumferential direction and a notch formed between two adjacent convex teeth;

a supporting frame, and a suspension edge provided around said vibration unit and connected to said supporting frame, wherein said suspension comprises:

an inner suspension edge portion for connecting with the vibration unit, wherein said inner suspension edge portion comprises an inner suspension edge body and one or more inner side elastic ribs radially protruded from said inner suspension edge body, wherein each of said inner side elastic ribs forms a bulge on a first side of said inner suspension edge portion and a flute on an opposite side thereof; and an outer suspension edge portion for connecting with the supporting frame, wherein said outer suspension edge portion comprises an outer suspension edge body and one or more outer side elastic ribs radially protruded from said outer suspension edge body, wherein each of said outer side elastic ribs forms a protrusion on a first side of said outer suspension edge portion and a groove on an opposite side thereof.

17. The speaker, as recited in claim 16, wherein said supporting frame comprises a first support frame and a second support frame connected with said first support frame, wherein said suspension edge is connected to said first support frame and said second support frame supports said magnetic coil unit.

18. The speaker, as recited in claim 17, wherein said first support frame comprises a plurality of wave-shaped protruding teeth annularly arranged inside and an indented groove formed between two adjacent protruding teeth, wherein each outer side elastic ribs are outwardly extended from an external edge of two adjacent protruding teeth which form said indented groove.

19. The speaker, as recited in claim 16, wherein each inner side elastic ribs are outwardly extended from an outer edge of two adjacent convex teeth, wherein each of the convex teeth has a triangular cross-section.

20. The speaker, as recited in claim 16, wherein said inner side elastic ribs are aligned with said outer side elastic ribs along a radial direction respectively.

21. The speaker, as recited in claim 16, wherein said inner side elastic ribs are integrally extended to said outer side elastic ribs respectively, wherein each of said inner side elastic ribs has an increased height and width along said suspension edge.

22. The speaker, as recited in claim 16, further comprising a connection edge integrally extended between said inner suspension edge portion and said outer suspension edge portion, wherein said inner side elastic ribs and said outer side elastic ribs are respectively positioned on two sides of said connection edge respectively, wherein said inner suspension edge portion and said outer suspension edge portion are integrally connected and formed an arch-shaped configuration, wherein said connection edge forms and extends along a peak which is formed between said inner suspension edge portion and said outer suspension edge portion.

23. The speaker, as recited in claim 16, wherein said inner side elastic ribs are integrally formed with said inner suspension edge body, wherein each of said inner side elastic ribs comprise a first section at a left side thereof and a second section at a right side thereof, wherein said first section and said second section are integrally connected, wherein each of said inner side elastic ribs is configured to have an arched structure that a connection part of said first section and said second section is the highest point of said arched structure.

24. The speaker, as recited in claim 16, further comprising a connecting body integrally extended from said inner suspension edge portion for overlapping on the vibration unit.

* * * * *